US010871343B2

(12) United States Patent
Chia et al.

(10) Patent No.: US 10,871,343 B2
(45) Date of Patent: Dec. 22, 2020

(54) EASY LOADING TOY PROJECTILE LAUNCHER

(71) Applicant: Easebon Services Limited, Kwun Tong (HK)

(72) Inventors: Francis See Chong Chia, Kowloon (HK); Steven J. Huebl, Jordon, MN (US)

(73) Assignee: Easebon Services Limited, Kwun Tong (HK)

( * ) Notice: Subject to any disclaimer, the term of this patent is extended or adjusted under 35 U.S.C. 154(b) by 0 days.

(21) Appl. No.: 16/843,337

(22) Filed: Apr. 8, 2020

(65) Prior Publication Data

US 2020/0232748 A1 Jul. 23, 2020

Related U.S. Application Data

(63) Continuation of application No. 15/991,683, filed on May 29, 2018, now Pat. No. 10,648,767, which is a continuation-in-part of application No. 15/850,130, filed on Dec. 21, 2017, now Pat. No. 10,648,763.

(51) Int. Cl.

| | |
|---|---|
| ***F41B 7/00*** | (2006.01) |
| ***F41B 4/00*** | (2006.01) |
| ***F41B 11/53*** | (2013.01) |
| ***F41B 7/08*** | (2006.01) |
| ***F41A 9/01*** | (2006.01) |
| ***F41B 11/52*** | (2013.01) |

(52) U.S. Cl.

CPC ..... *F41B 7/08* (2013.01); *F41A 9/01* (2013.01); *F41B 4/00* (2013.01); *F41B 7/006* (2013.01); *F41B 11/52* (2013.01); *F41B 11/53* (2013.01)

(58) Field of Classification Search

CPC .... F41B 4/00; F41B 7/006; F41B 7/08; F41B 11/50; F41B 11/52; F41B 11/53; F41B 11/54; F41B 11/55; F41B 11/89; F41A 9/00; F41A 9/01; F41A 9/02

USPC ..... 124/45, 49, 51.1, 52, 78; 446/473

See application file for complete search history.

(56) References Cited

U.S. PATENT DOCUMENTS 2,753,977 A * 7/1956 Ransohoff ..... G01G 13/02 198/582

3,191,588 A * 6/1965 Thew ..... F41B 7/006 124/27

(Continued)

*Primary Examiner* — Alexander R Niconovich

(74) *Attorney, Agent, or Firm* — Amster, Rothstein & Ebenstein LLP

(57) ABSTRACT

A toy projectile launcher for launching projectiles, e.g, toy foam darts, from a hopper. One or more agitating members inside the hopper to enable the projectiles to drop into a firing chamber under the hopper. A hopper cover has a collapsible ceiling with nested members and a ceiling plate to maintain the projectiles toward the bottom of the hopper. A catch coupled to the ceiling plate engages an opening in a hopper wall to prevent the ceiling from collapsing when the hopper cover is closed. Where there are multiple vertically spaced-apart openings in the hopper wall, the catch may disengage from a first opening, and then engage a lower, second opening in the hopper wall, as the number of projectiles in the hopper drops and the ceiling plate descends in the hopper. A rotating track and a push rod advance projectiles from the firing chamber to flywheels for launch.

14 Claims, 21 Drawing Sheets

(56) References Cited

U.S. PATENT DOCUMENTS 3,348,531 A * 10/1967 Yano ..... F41B 7/006 124/27
4,168,695 A * 9/1979 Haller ..... A63B 69/408 124/16
5,282,454 A * 2/1994 Bell ..... F41A 9/48 124/49
5,794,606 A * 8/1998 Deak ..... F41B 11/53 124/51.1
6,327,953 B1 * 12/2001 Andresen ..... F41A 9/02 124/45
6,408,837 B1 * 6/2002 Johnson ..... F41B 11/681 124/51.1
6,415,781 B1 * 7/2002 Perrone ..... F41B 11/53 124/51.1
6,481,432 B2 * 11/2002 Rushton ..... F41B 11/57 124/49
6,644,293 B2 * 11/2003 Jong ..... A45F 5/02 124/52
6,981,493 B1 * 1/2006 Poteracke ..... F41B 11/50 124/45
7,051,727 B2 * 5/2006 Wu ..... F41B 4/00 124/6
7,222,617 B2 * 5/2007 Andresen ..... F41A 9/02 124/48
7,441,556 B2 * 10/2008 Friesen ..... F41B 11/53 124/51.1
7,640,924 B2 * 1/2010 Cherepanov ..... F41B 11/57 124/51.1
7,770,569 B2 * 8/2010 Andresen ..... F41B 11/53 124/51.1
8,021,208 B2 * 9/2011 Victor ..... F41A 9/70 446/473
8,047,190 B2 * 11/2011 Kaakkola ..... F41B 11/57 124/48
8,235,030 B2 * 8/2012 Kaakkola ..... F41B 11/52 124/49
8,353,277 B2 * 1/2013 Huebl ..... F41B 11/89 124/78
8,596,254 B2 * 12/2013 Brooks ..... F41B 7/006 124/52
8,776,693 B2 * 7/2014 Toeckes ..... F41A 19/01 102/364
9,027,541 B2 * 5/2015 Huebl ..... F41B 11/681 124/56
9,212,864 B2 * 12/2015 Christopher ..... F41B 11/57
9,255,749 B2 * 2/2016 Faifer ..... F16F 1/04
9,658,027 B2 * 5/2017 Stevens ..... F41B 11/71
9,958,230 B1 * 5/2018 Nugent ..... F41A 9/73
10,072,905 B2 * 9/2018 Skupin ..... F42B 39/02
2002/0166551 A1 * 11/2002 Lee ..... F41B 4/00 124/78
2005/0252500 A1 * 11/2005 Morikawa ..... F41B 11/89 124/71
2005/0274371 A1 * 12/2005 Lubben ..... F41B 11/53 124/51.1
2007/0012304 A1 * 1/2007 van Dorsser ..... F41B 11/57 124/51.1
2007/0056573 A1 * 3/2007 Campo ..... F41B 11/53 124/49
2011/0067681 A1 * 3/2011 Stevens ..... F41B 11/53 124/51.1
2011/0271941 A1 * 11/2011 Meggs ..... F41B 11/641 124/65
2012/0285434 A1 * 11/2012 Andersen ..... F41B 11/53 124/51.1
2013/0112184 A1 * 5/2013 Corsiglia ..... F42B 6/00 124/78

* cited by examiner

EASY LOADING TOY PROJECTILE LAUNCHER

CROSS-REFERENCE TO RELATED APPLICATION

This application is a continuation of and claims the benefit of and priority to U.S. patent application Ser. No. 15/991,683 filed May 9, 2019, which is a continuation-in-part of and claims the benefit of and priority to U.S. patent application Ser. No. 15/850,130 filed Dec. 21, 2017, the entire contents of each of which are incorporated herein by reference as if fully set forth herein.

FIELD

The present invention generally relates to a toy projectile launcher capable of launching a substantially large number of projectiles without reloading.

BACKGROUND

Toy guns that discharge soft projectiles, such as toy foam darts—commonly referred to as "launchers" or "shooters"—are well known in the art. A typical magazine that holds darts that are discharged by such launchers is a clip or a cartridge that has an open top, a closed bottom, and a biasing spring that biases the darts upwardly, from the bottom of the magazine to the top.

Currently, darts are loaded into empty magazines one dart at a time. The time and effort it takes to reload a launcher that can launch a multitude of darts in this manner is one of the most frustrating aspects of playing with a launcher. Specifically, during the time period that one is reloading a launcher, one is vulnerable to being shot at by one's opponents in a dart war game. This situation could be alleviated by carrying a spare magazine, a belt with a plurality of spare magazines, a drum, or some other source of spare darts. However, there is a limit to the number of spare magazines that one could carry.

Furthermore, although it also follows that a launcher that could launch a lot of darts will yield more fun between reloads, the downside to being able to launch a lot of darts is that it will take longer amount of time to reload the launcher. Thus, a key determinant to ensuring a pleasurable and satisfying experience when using a toy projectile launcher remains the amount time it takes to reload the launcher. Accordingly, a system for reducing the time required to reload a toy projectile launcher is desirable.

SUMMARY

The present invention generally relates to toy projectile launchers, and in embodiments, to a projectile launcher that enables a user to load the launcher simply by grabbing a handful of projectiles and dropping them into a container that leads directly to the firing chamber of the launcher.

According to an exemplary embodiment of the present invention, a toy projectile launcher includes a housing defining an interior recess and a hopper coupled to the interior recess of the housing. The hopper is configured to house one or more projectiles and to provide the one or more projectiles to the interior recess of the housing so that they can be launched from the housing. The hopper includes a wall and an agitating member that is associated with the wall and is configured to cause the one or more projectiles to move within the hopper.

In embodiments, an opening may be provided in the agitating member.

In embodiments, the toy projectile launcher may include a wheel having a finger extending therefrom, and the wheel may protrude through the opening in the agitating member.

In embodiments, the agitating member may be agitated as a result of contact between the finger and an edge of the opening in the agitating member.

In embodiments, the agitating member may slope downwardly from the wall to the housing to guide the one or more projectiles into the housing.

In embodiments, the interior recess of the housing may include a firing chamber, and the agitating member may guide the one or more projectiles into the firing chamber.

In embodiments, the firing chamber may include a rotating track to advance the one or more projectiles from the firing chamber.

In embodiments, the one or more projectiles may be provided to the interior recess of the housing one at a time.

In embodiments, the agitating member may be coupled to the wall by a hinge.

In embodiments, the one or more projectiles may include toy foam darts.

According to an exemplary embodiment of the present invention, a toy projectile launcher includes a housing defining an interior recess and a hopper coupled to the interior recess of the housing. The hopper is configured to house one or more projectiles and to provide the one or more projectiles to the housing so that they can be launched from the housing. The hopper includes a first wall, an agitating member associated with the first wall and configured to cause the one or more projectiles to move within the hopper, a cover having an underside which faces into the hopper, and a ceiling that is collapsibly attached to the underside of the cover.

In embodiments, the ceiling may include a plurality of nested members attached to the underside of the cover.

In embodiments, the plurality of nested members may expand into the hopper when the cover is closed.

In embodiments, the ceiling may rest on top of the one or more projectiles that are housed in the hopper.

In embodiments, the ceiling may include a spring attached to the underside of the cover.

According to an exemplary embodiment of the present invention, a toy projectile launcher includes a housing defining an interior recess and a hopper coupled to the interior recess of the housing. The hopper is configured to house one or more projectiles and to provide the one or more projectiles to the housing so that they can be launched from the housing. The hopper includes a wall that is movable to facilitate loading of the one or more projectiles into the hopper.

In embodiments, the wall may be rotatable about the housing for a predetermined distance.

In embodiments, the wall may be movable to a degree that accommodates entry of a partially closed first of a user into the hopper.

In embodiments, the wall may be a rear wall of the hopper.

In embodiments, the toy projectile launcher may include a cover for the hopper that is rotatably coupled to the rear wall.

According to an exemplary embodiment of the present invention, a toy projectile launcher includes a housing defining an interior recess, a firing chamber disposed within the interior recess and configured to receive a projectile, a rotating track disposed at a bottom of the firing chamber to advance the projectile out of the firing chamber, and a push rod configured to enter the firing chamber. The push rod cooperates with the rotating track to advance the projectile from the firing chamber.

In embodiments, the push rod may push the projectile as the projectile is being advanced from the firing chamber by the rotating track.

In embodiments, a tip of the push rod may extend halfway into the firing chamber.

In embodiments, the push rod may be a reciprocating push rod.

In embodiments, the firing chamber may be configured to receive one projectile at a time.

According to an exemplary embodiment of the present invention, a toy projectile launcher includes a housing defining an interior recess, and a hopper coupled to the interior recess of the housing. The hopper is configured to house one or more projectiles, such as toy foam darts, and to provide the one or more projectiles to the housing to be launched from the housing. The hopper includes a first wall and a front wall, an agitating member coupled to the first wall and configured to cause the one or more projectiles to move within the hopper, a cover having an underside which faces into the hopper, a plurality of openings in the first wall or the front wall, wherein the openings are spaced apart from one another and extend in substantial alignment from an upper position to a lower position on one of the first or front walls, a ceiling having a ceiling plate that is collapsibly attached to the underside of the cover and is expandable downward from the cover into the hopper when the cover is closed, and a catch that is coupled to the ceiling plate and configured to engage with at least a first opening of the plurality of openings when the hopper is loaded with a first amount of the one or more projectiles to prevent the cover from collapsing back into the underside of the cover when the cover is closed onto the hopper.

In embodiments, the catch is further configured to disengage from the first opening and engage with a second opening of the plurality of openings located at a second position lower in the hopper than the first position when the hopper is loaded with a second amount of the one or more projectiles following a launch of one or more of the one or more projectiles from the hopper, wherein the second amount of the one or more projectiles is less than the first amount is loaded in the hopper.

In embodiments, the catch is coupled to the ceiling plate with a spring to allow engagement and disengagement of the catch from one or more of the plurality of openings.

In embodiments, the catch is configured to disengage from any of the plurality of openings in which the catch is engaged upon an opening of the cover of the hopper.

In embodiments, the ceiling plate is configured to rest on top of the one or more projectiles housed in the hopper.

In embodiments, the ceiling further includes a plurality of nested members, between an interior side of the ceiling plate and the underside of the cover, wherein the plurality of nested members are extendible downward from the cover.

In embodiments, the ceiling plate includes a spring attached to the underside of the cover.

In embodiments, the plurality of openings are substantially vertically aligned.

In embodiments, the hopper includes a third wall that is movable to facilitate loading of the one or more projectiles into the hopper. The third wall may be rotatable about the housing for a predetermined distance and may be movable to a degree that accommodates entry of a partially closed first of a user into the hopper.

In embodiments, the third wall includes a rear wall of the hopper. In embodiments, the cover for the hopper is rotatably coupled to the rear wall.

In embodiments, the toy projectile launcher further includes a third wall opposite the first wall, and a second agitating member coupled to the third wall and configured to cause the one or more projectiles to move within the hopper.

According to an exemplary embodiment of the present invention, a toy projectile launcher includes a housing defining an interior recess, and a hopper coupled to the interior recess of the housing, the hopper configured to house one or more projectiles, such as toy foam darts, and to provide the one or more projectiles to the interior recess of the housing to be launched. The hopper includes a first wall on a first side of the hopper, a second wall on a second side of the hopper opposite the first wall, and at least two agitating members, including a first agitating member associated with the first wall, and a second agitating member associated with the second wall. The first and second agitating members are configured to cause the one or more projectiles to align within the hopper.

In embodiments, the first and second agitating members are agitated by different agitating mechanisms.

In embodiments, the first and second agitating members are configured to be agitated substantially simultaneously.

In embodiments, the first and second agitating members are configured to be agitated one at a time.

In embodiments, the first and second agitating members are configured to be sequentially activated with agitation in the hopper alternating between agitation by the first agitating member and agitation by the second agitating member.

In embodiments, the toy projectile launcher further includes a first wheel having a finger extending therefrom and configured to agitate the first agitating member by intermittent contact between the finger and the first agitating member.

In embodiments, the toy projectile launcher further includes a second wheel coupled to a arm that is configured to agitate the second agitating member by intermittent contact between the arm and the second agitating member. In embodiments, the second wheel is configured to rotate in a single direction. In embodiments, the second wheel is configured to alternate between rotation in a clockwise direction and in a counterclockwise direction.

In embodiments, the first agitating member slopes downwardly to the housing to guide the one or more projectiles into the interior recess of the housing.

In embodiments, the second agitating member slopes downwardly to the housing to guide the one or more projectiles into the interior recess of the housing.

In embodiments, the interior recess of the housing includes a firing chamber, and the first and second agitating members are configured to guide the one or more projectiles into the firing chamber. In embodiments, the firing chamber includes a rotating track to advance the one or more projectiles from the firing chamber.

In embodiments, the one or more projectiles are to be provided to the interior recess of the housing one at a time.

In embodiments, the first agitating member is coupled to the first wall by a first hinge and the second agitating member is coupled to the second wall by a second hinge.

BRIEF DESCRIPTION OF THE DRAWINGS

Various exemplary embodiments of this invention will be described in detail, with reference to the following figures, wherein.

DETAILED DESCRIPTION

Figure 1:
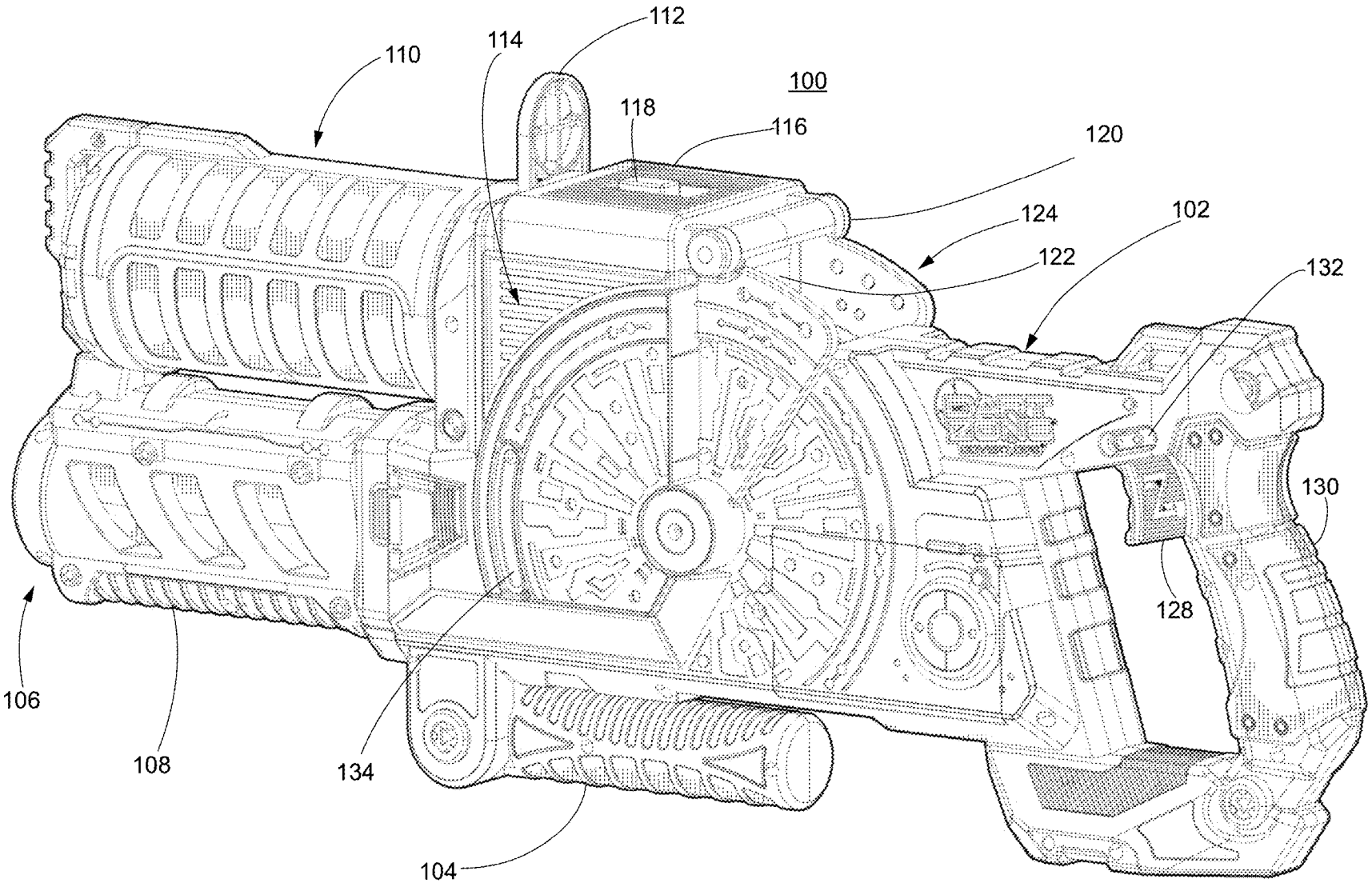
FIG. 1 shows a left side perspective view of a toy projectile launcher in accordance with exemplary embodiments of the present invention.
Figure 2:
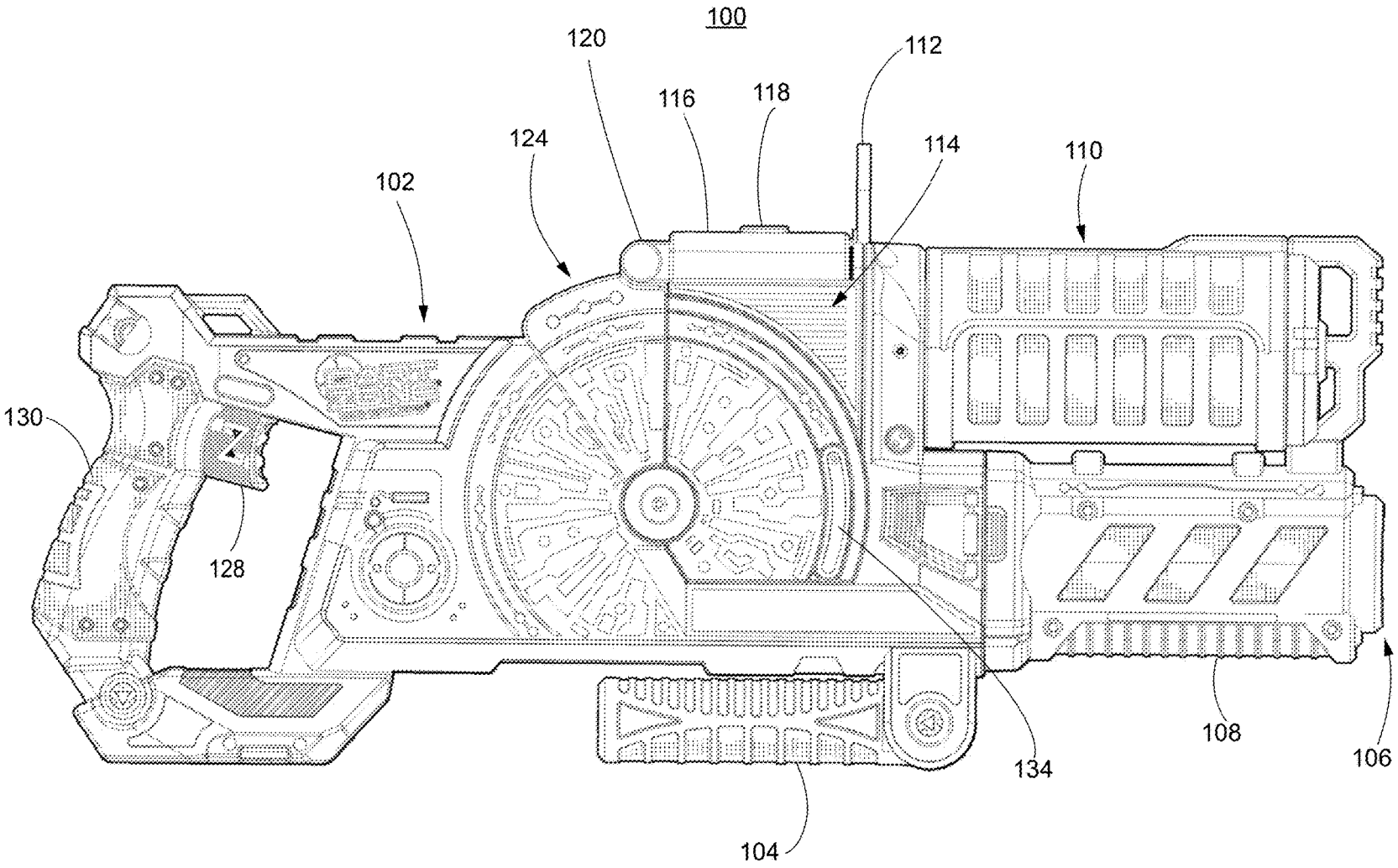
FIG. 2 shows a right side view of the toy projectile launcher shown in FIG. 1.
Figure 3:
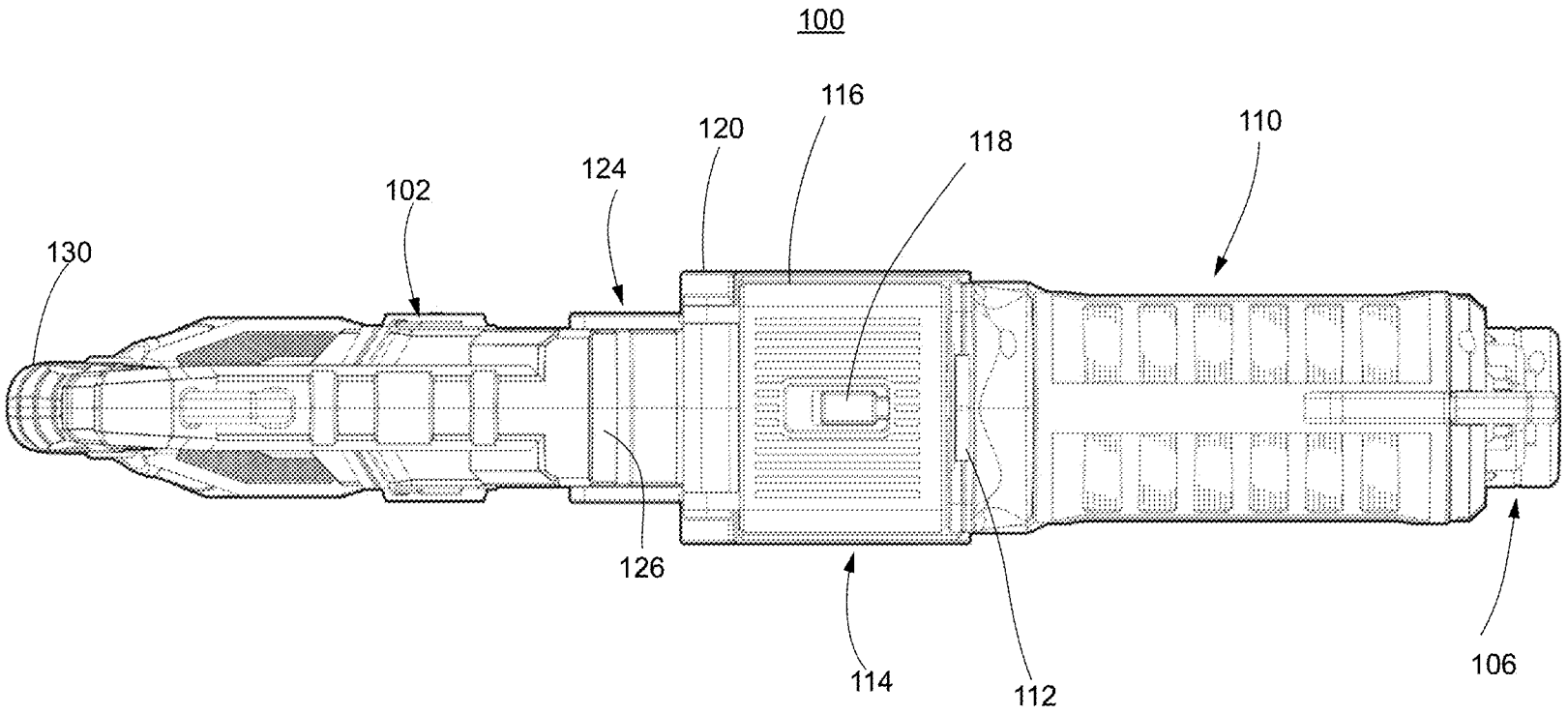
FIG. 3 shows a top view of the toy projectile launcher shown in FIG. 1.
Figure 4:
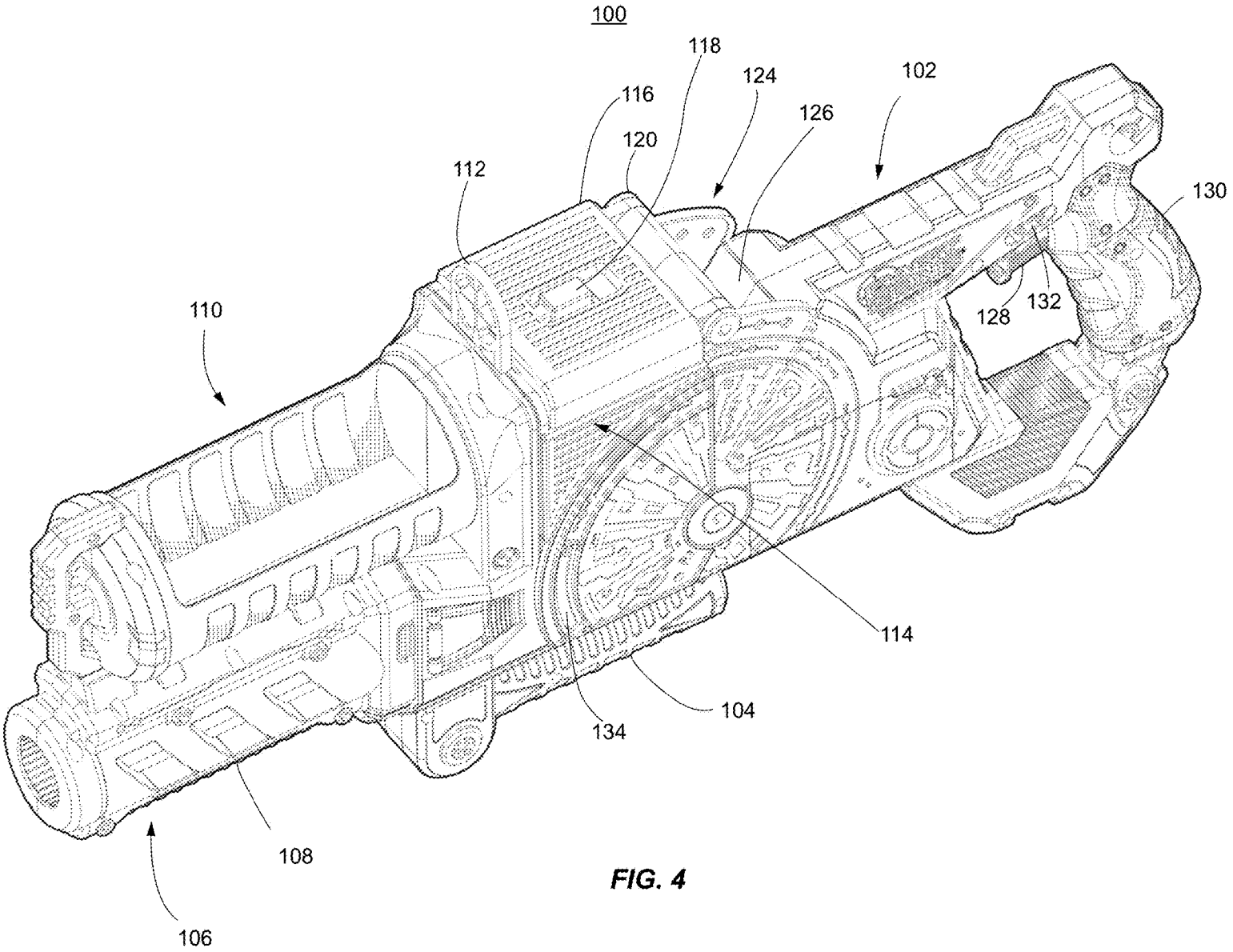
FIG. 4 shows a top, left side perspective view of the toy projectile launcher shown in FIG. 1.

The present invention is directed towards a projectile launcher—for example, a toy foam dart launcher—that is capable of launching a substantially large number of projectiles in rapid succession, thereby reducing the number of times needed to reload the projectile launcher. To increase the number of projectiles that can be launched between reloadings, the projectiles are housed in a hopper. The hopper may include a movable rear wall which facilitates the loading of a large number of projectiles into the hopper at one time. In addition, a portion of a side wall of the hopper may be agitated to loosen the projectiles within the hopper so that they will drop into a firing chamber of the toy projectile launcher more easily. Furthermore, a cover for the hopper may have a collapsible ceiling to prevent the projectiles from becoming improperly oriented in the hopper as they are being loosened by the agitated portion of the side wall of the hopper. These features, standing alone or in combination, enable a user to load the toy launcher with a substantially large number of projectiles, thus reducing the number of times the user must reload the toy launcher.

The use of hoppers and vibrating chutes is known in large-scale industrial manufacturing processes. For example, U.S. Pat. No. 2,753,977 ("the '977 patent"), entitled "Feeding Apparatus for Nail Weighing Machines," discloses a feed mechanism for a nail weighing machine. The feed mechanism includes a supply hopper which has an open top for receiving nails, an opening at its lower end through which nails are provided to a conveyor of the nail weighing machine, and side walls which incline downwardly toward one another in the direction of the lower-end opening. As described in the '977 patent, when nails are dumped into the supply hopper, the inclined nature of the side walls tends to cause the nails to jam between the side walls. To prevent the jamming of the nails between the side walls, the supply hopper 50 includes a vibrating panel or side wall located in the hopper.

However, such large-scale industrial hoppers do not teach the use of a hopper structure in the environment of a toy foam dart shooter. For instance, the hopper disclosed in the '977 patent provides nails to a vibrating conveyor. As such, the nails are not delivered to the nail weighing machine rapidly, and they are delivered without regard to the direction in which the nails are pointing. In contrast, in a toy foam dart shooter in accordance with embodiments of the present invention, it is critical to be able to deliver the darts into the firing chamber of the dart launcher as rapidly as possible and with their tips pointed toward the barrel of the launcher. Furthermore, in a typical magazine for a toy foam dart launcher (e.g., a clip or a cartridge), the darts are biased upwardly, from the bottom of the magazine to its top, for loading into the firing chamber of the launcher. Thus, toy dart launchers have heretofore not had a need to vibrate or shake a dart (or any other type of projectile or accessory) downwards, and providing such a capability would only increase the cost of the launcher (by requiring a battery-operated motor) without providing any benefit.

It was not until the present invention that the applicability and advantages of the novel use of a hopper structure, and related features, have been recognized and appreciated in the context of a toy foam dart shooter. As described in detail below, a toy foam dart launcher in accordance with embodiments of the present invention advantageously employs a hopper structure to enable a user to load a toy dart launcher with a substantially large number of projectiles more quickly and more easily.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

Referring to FIGS. 1-6, a toy projectile launcher 100 may be configured to launch one or more projectiles (not shown) therefrom. In embodiments, the projectiles may be non-lethal projectiles for use in recreational activities, and may be, for example, darts, arrows, balls, and/or discs, to name a few, in any combination or separation. The projectiles may include one or more performance-enhancing and/or decorative features, for example, suction cups, fins, whistles and/or other sound generating devices, one or more fluid-retaining portions, dyes or other transferable colorants, and/or collapsible portions, to name a few.

The projectiles may be formed of a lightweight and/or force-dampening material such as foam, rubber, or the like, so that the projectiles are suitable for use in play and/or sport activities involving, for example, children. In this manner, the projectiles are configured to impact a target, such as a portion of a human body, an animal, or an inanimate object without causing discomfort, pain, and/or damage thereto. In exemplary embodiments, the projectiles may be toy foam darts of the type described in U.S. Pat. No. 9,285,194 entitled "Foam Dart Having a Safety Cap," the entire contents of which are incorporated by reference herein. For convenience, the following description of projectile launcher 100 assumes that the projectiles are toy foam darts.

Figure 7A:
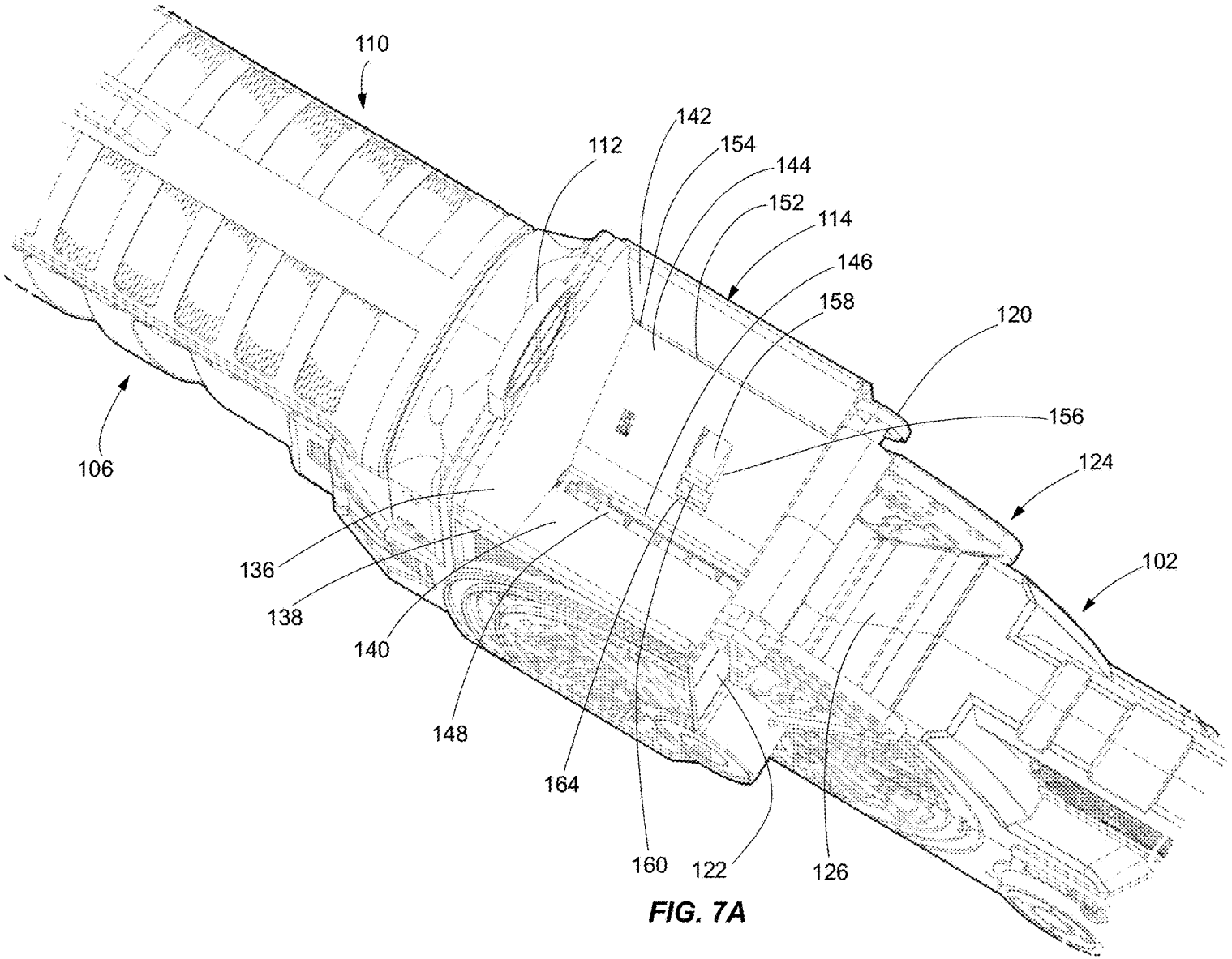
FIGS. 7A, 7B, and 7C illustratively depict various elements of the toy projectile launcher in accordance with exemplary embodiments of the present invention.
Figure 7C:
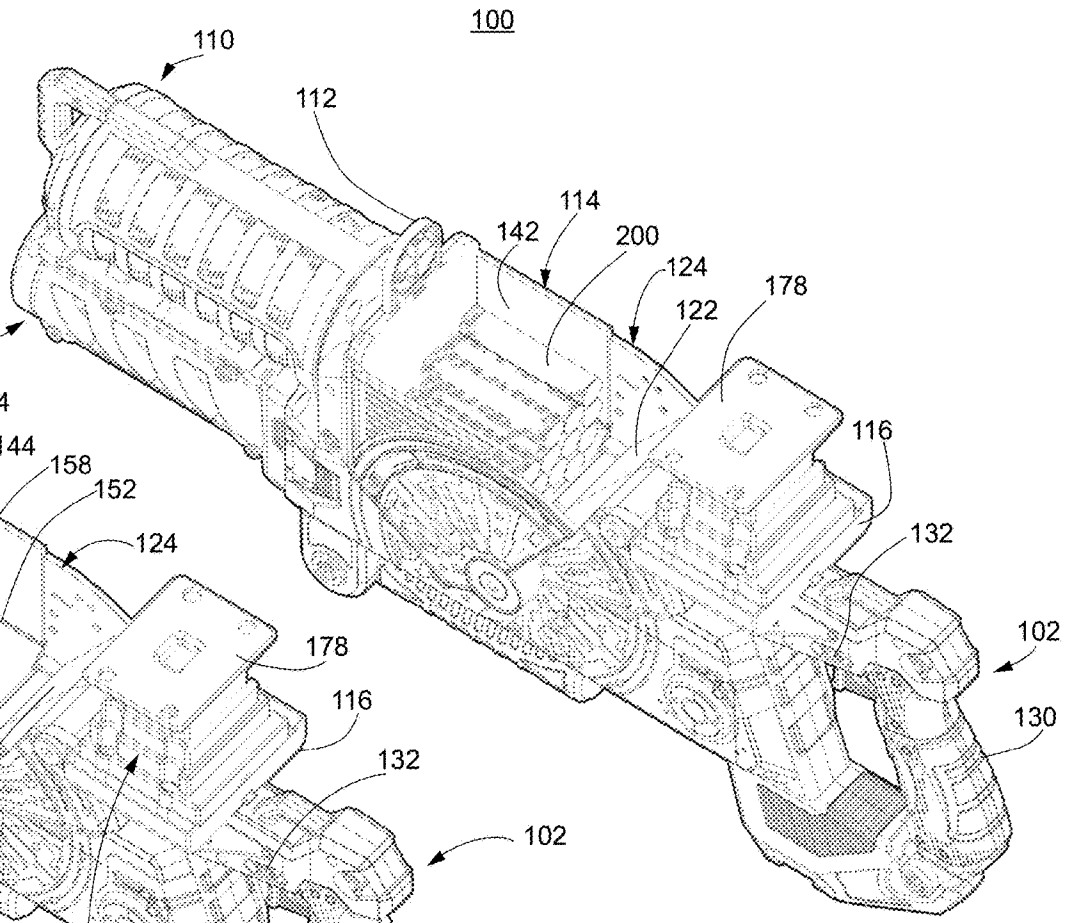
Figure 7B:
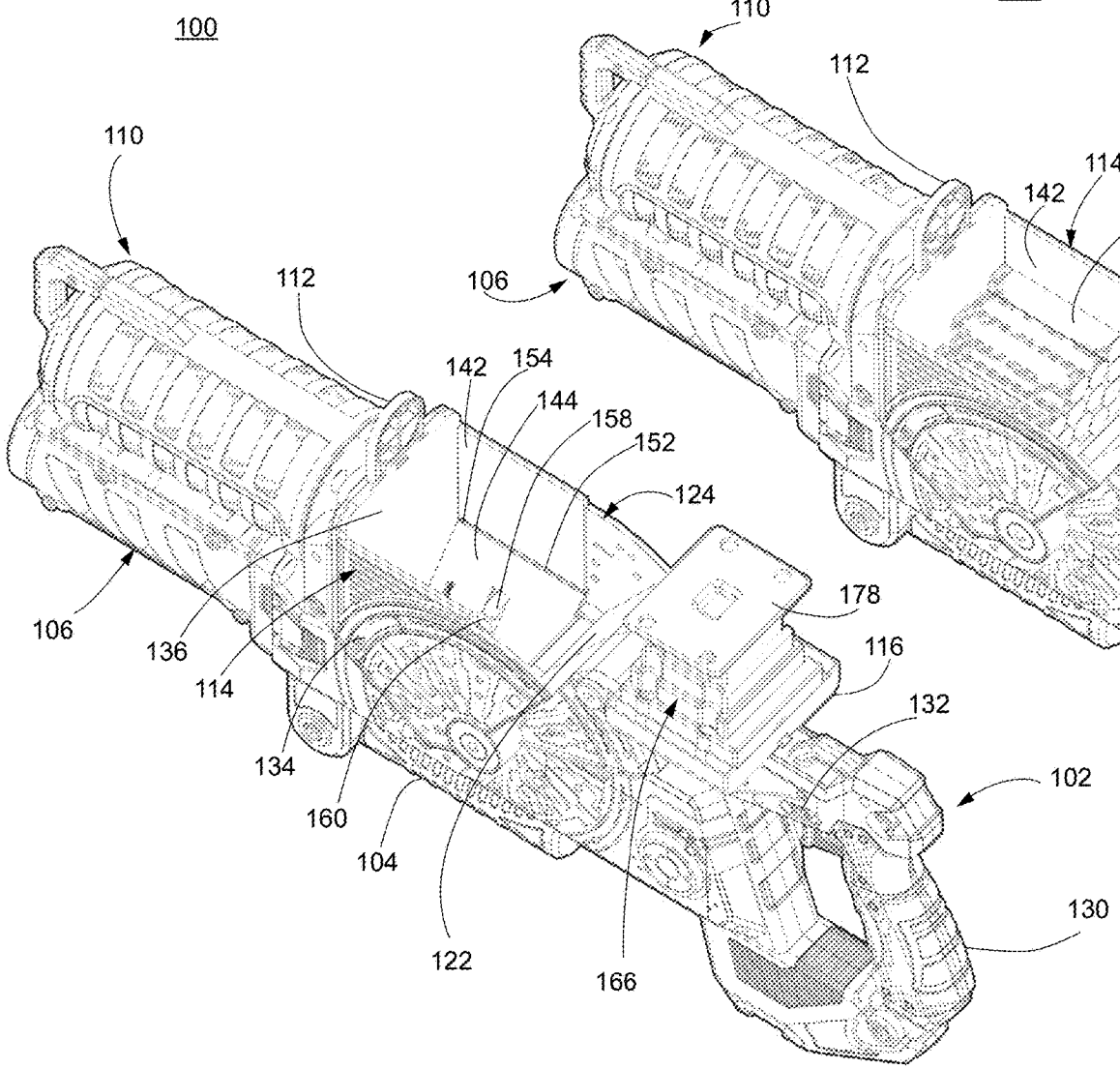
Figure 8:
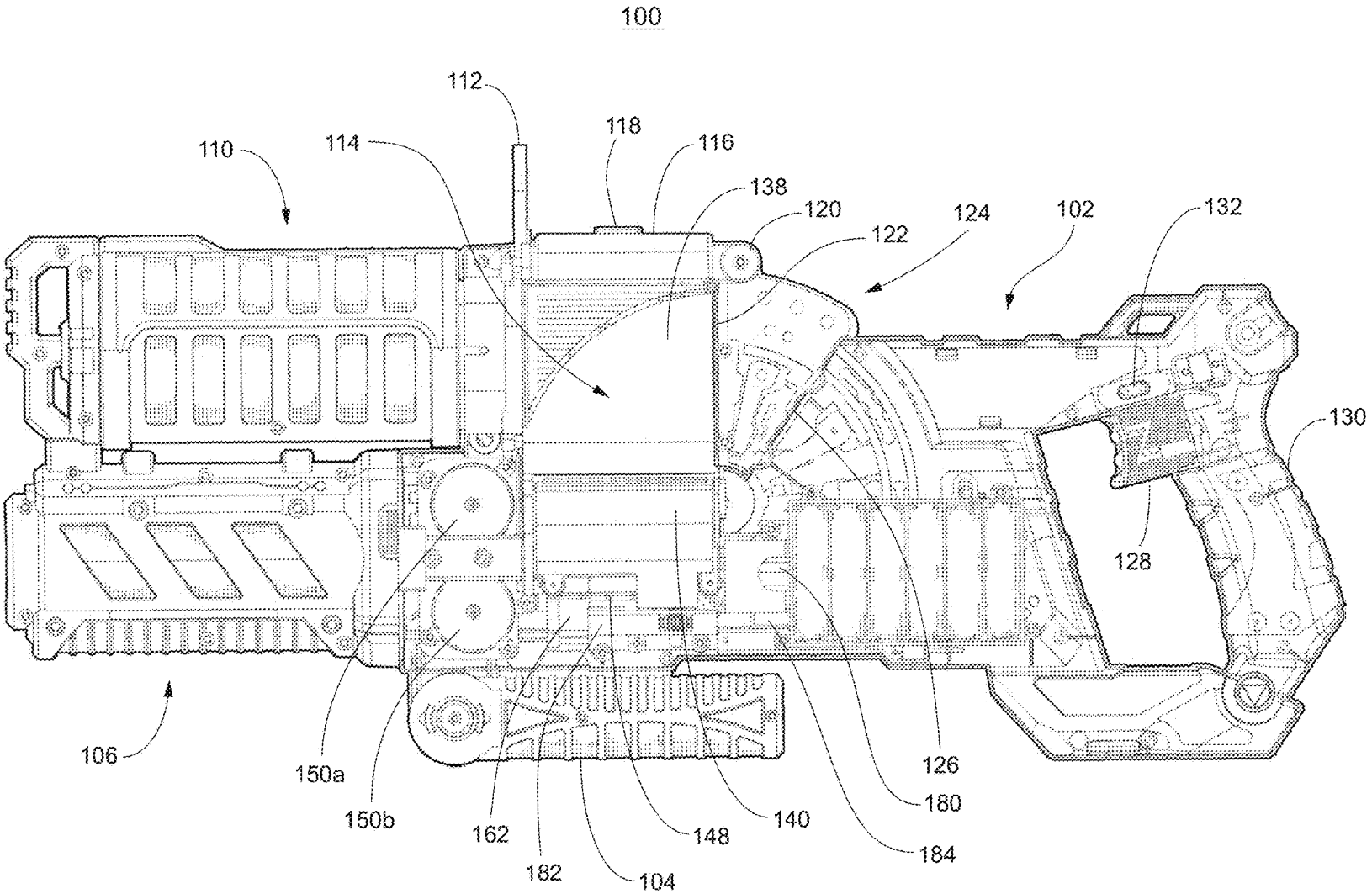
FIG. 8 illustratively depicts various elements of the toy projectile launcher in accordance with exemplary embodiments of the present invention.
Figure 9:
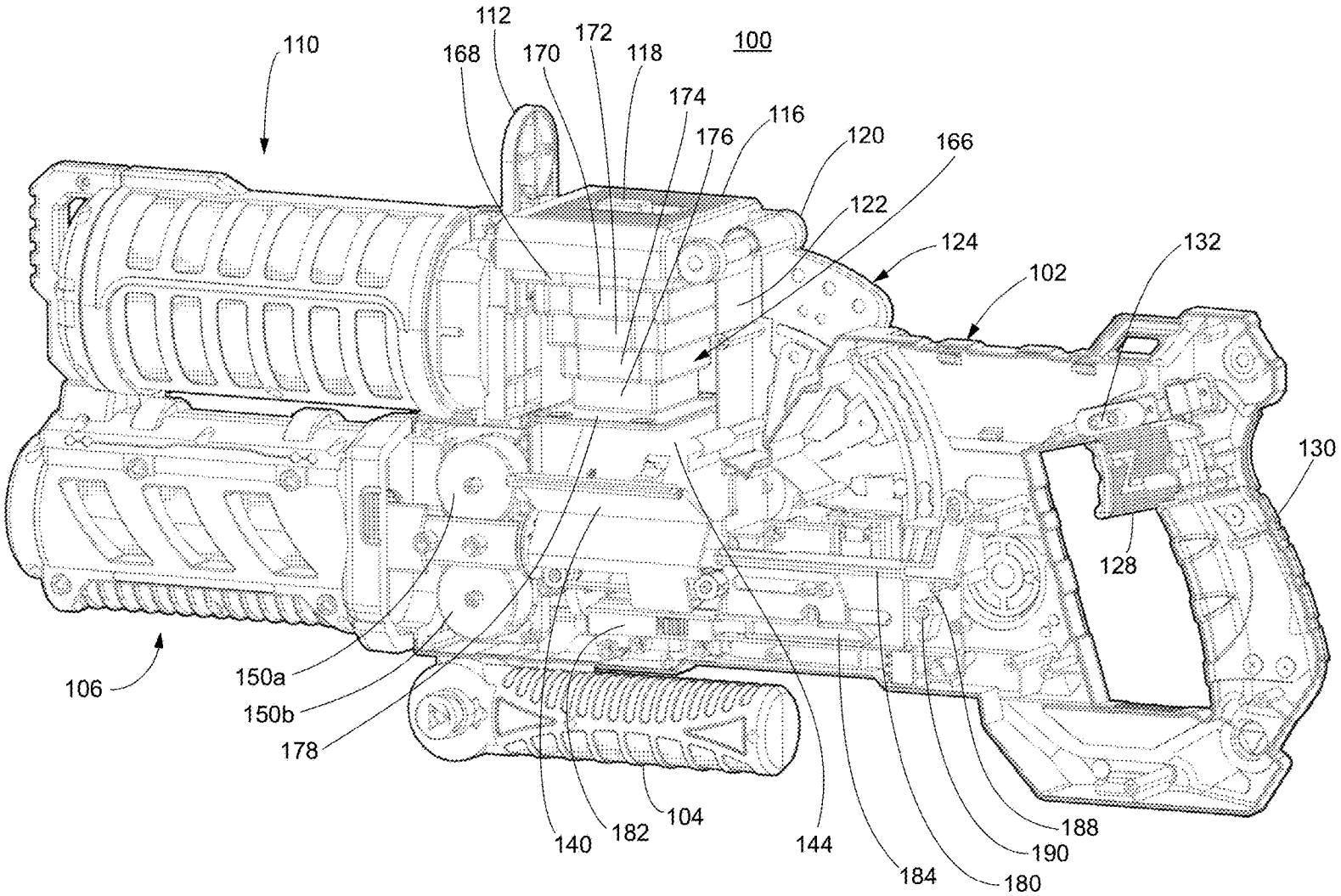
FIG. 9 illustratively depicts various elements arranged in an interior recess of the housing of the toy projectile launcher in accordance with exemplary embodiments of the present invention.

Projectile launcher 100 includes a housing 102. In embodiments, housing 102 may include various external handling or mounting structures, such as a retractable forward grip 104, a detachable barrel 106, a storage compartment 110 for storing extra projectiles, and a sighting member 112. Retractable forward grip 104 may be rotatable such that it may be positioned rearward as in FIG. 1, forward as in FIG. 12A, or at a position therebetween. Barrel 106 may include an underside grip 108. As shown in FIGS. 7A and 8, housing 102 has a hollow interior recess to accommodate the internal components of launcher 100.

Figure 5:
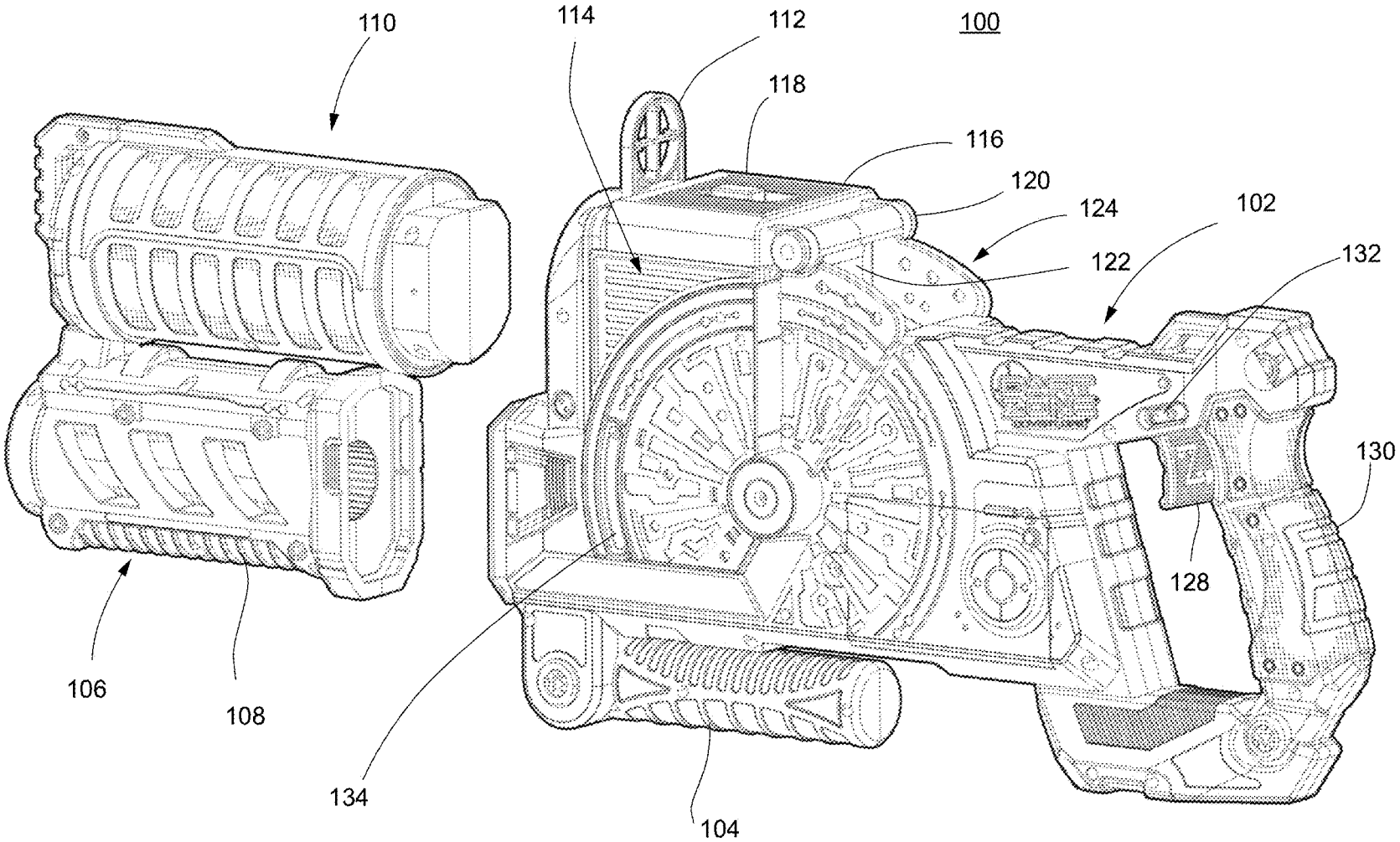
FIG. 5 shows an exploded view of the toy projectile launcher shown in FIG. 1.
Figure 6:
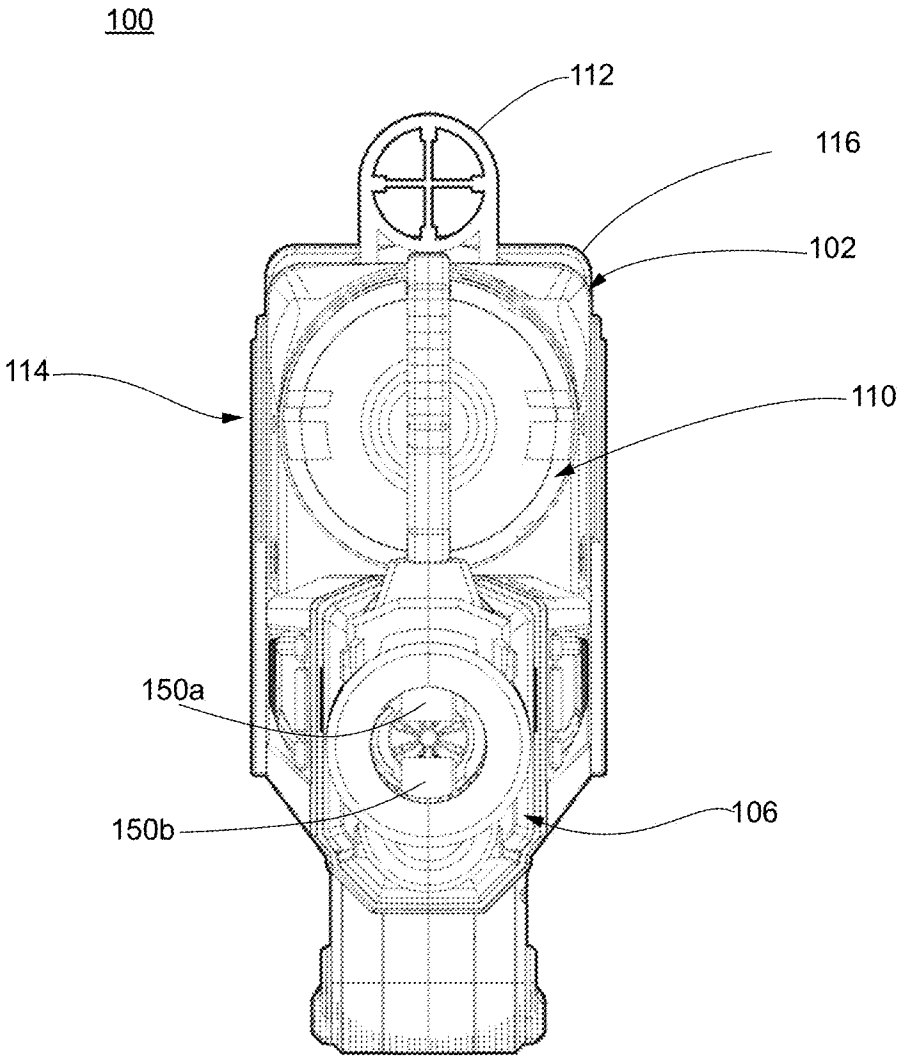
FIG. 6 shows a front view of the toy projectile launcher shown in FIG. 1.

As shown in FIG. 5, barrel 106 and storage compartment 110, and various other external structures, may be attached and/or connected and/or interfit and/or otherwise detachably coupled with housing 102. In alternative embodiments, barrel 106, underside grip 108, storage compartment 110, and various other external structures may be monolithically formed with the housing 102 of projectile launcher 100. In embodiments, the housing 102 may also be configured to receive various accessories for projectile launcher 100, for example, a scope, and/or a source of illumination, to name just a few additional accessories.

Referring now to FIGS. 5 and 7A, in exemplary embodiments, projectile launcher 100 includes a hopper 114 to house darts that will be launched from projectile launcher 100 through barrel 106. Hopper 114 is enclosed by a cover 116, a front wall 136, side walls 138 and 142, and a portion 122 (i.e., a rear wall) of a movable rear wall assembly 124. As described in detail below, movable rear wall assembly 124 facilitates the loading of darts into the hopper 114. Cover 116 sits atop hopper 114, and is rotatably coupled to rear wall assembly 124 by hinge 120. Cover 116 is locked in place by pushing switch 118 forward (i.e., toward sighting member 112). In embodiments, this causes a latch 117 on the top front of cover 116 to engage a slot 119 on the front wall of the hopper 114 to hold the hopper cover 116 closed.

To load darts into hopper 114, the user first unlocks cover 116 by moving switch 118 backwards (i.e., toward hinge 120). The user then rotates cover 116 backwards around hinge 120, and opens rear wall assembly 124 by moving it backwards (i.e., towards rear grip 130). Rear wall assembly 124 rotates about housing 102 for a distance determined by its arcuate slots 134, until portion 122 of rear wall assembly 124 rests against portion 126 of housing 102.

With hopper 114 now open, the user can grab a handful of toy foam darts in his or her fist. In exemplary embodiments, the user can grab a maximum of about five foam darts at a time and, with the front of launcher 100 pointed downwards at a slight angle, place the darts in hopper 114 with the tips of the darts pointing toward the front of launcher 100 (i.e., toward barrel 106). (Since the tip of a dart is heavier than its foam body, the dart tips will be placed into hopper 114 first. Pointing the front of launcher 100 downwards at a slight angle thus allows the front wall 136 of hopper 114 to align the toy foam darts appropriately.) In exemplary embodiments, a maximum of forty darts can be loaded into the hopper 114 in this manner. Once a desired quantity of darts is loaded into hopper 114, the user pushes rear wall assembly 124 forward until portion 122 of rear wall assembly 124 sits flush against hopper 114, flips cover 116 around hinge 120 and back into place atop hopper 114, and locks cover 116 and rear wall assembly 124 into place by moving switch 118 forwards (i.e., toward sighting member 112).

As shown in FIGS. 5 and 7A-7C, the use of movable rear wall assembly 124 greatly facilitates rapid loading of the darts 200 into hopper 114. Specifically, when a user grabs a handful of darts 200, his or her first is in a generally closed position. When the user inserts his or her closed first into hopper 114 to deposit the darts 200 therein, with the tips of the darts pointing forward (i.e., toward barrel 106), the width of hopper 114 must be sufficiently large to ensure sufficient clearance. This poses a problem, however, because a wide container means a deep display package for launcher 100, which is uneconomical because it increases the costs associated with shipping commercial quantities of launcher 100. By providing a rear wall assembly 124 for hopper 114 which is capable of opening and closing as described above, it becomes possible for the partially closed first of a user to enter hopper 114 to deposit darts 200.

Referring now to FIGS. 7A-7C, 8, and 9, hopper 114 includes front wall 136 and side walls 138, 142. A first projectile guide member 140 slopes downwardly from the bottom of side wall 138 toward firing chamber 146. Similarly, a second projectile guide member 144 slopes downwardly from the bottom of side wall 142 toward firing chamber 146. In embodiments, the slope angle of first projectile guide member 140 with respect to side wall 138 may be approximately equal to the slope angle of second projectile guide member 144 with respect to side wall 142.

First and second projectile guide members 140, 144, along with rotating rubber track 148, cooperate to define a firing chamber 146 at the bottom of hopper 114. In exemplary embodiments, the dimensions of firing chamber 146 are such that it accepts a single projectile at a time.

In operation, and as described above, a user loads toy foam darts into hopper 114 by opening and closing cover 116 and rear wall assembly 124. Due to gravity, and guided by first and second projectile guide members 140, 144, the darts housed in hopper 114 drop down into firing chamber 146 one at a time as successive darts are launched from launcher 100.

Figure 10:
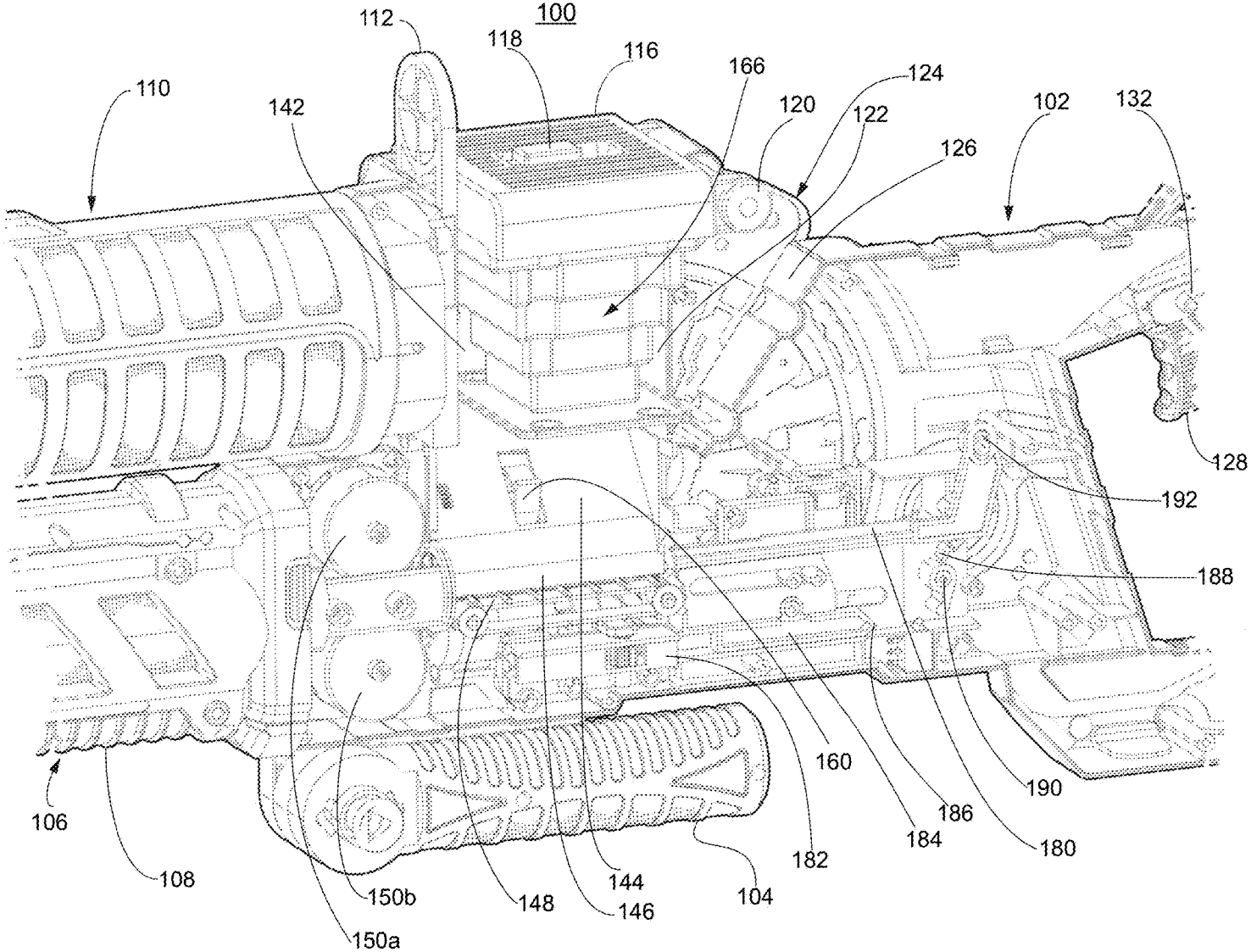
FIG. 10 illustratively depicts various elements of the toy projectile launcher in accordance with exemplary embodiments of the present invention.

In exemplary embodiments, when a toy foam dart is located in firing chamber 146, and the user pulls trigger 128, the dart is automatically delivered to a pair of spinning flywheels 150*a*, 150*b* using rotating rubber track 148 assisted by a reciprocating push rod 180. Referring to FIG. 10, as rubber track 148 rotates to advance a dart (not shown) from firing chamber 146 toward flywheels 150*a*, 150*b* (driven by one or more motors, not shown), cam 182 pushes follower 184 back until tapered edge 186 contacts arm 188. This contact causes arm 188 to rotate counterclockwise about pivot 190. Arm 188 is mechanically coupled to push rod 180 at opening 192 such that the counterclockwise rotation of arm 188 about pivot 190 moves push rod 180 forward, thereby pushing the dart in firing chamber 146 from the rear as it is being advanced toward flywheels 150*a*, 150*b* by rotating rubber track 148. In exemplary embodiments, the tip of push rod 180 may reach halfway along the length of firing chamber 146 when fully extended. The reciprocating action of push rod 180 is completed when cam 182 pulls follower 184 back, allowing arm 188 to rotate clockwise about pivot 190 and, consequently, returning push rod 180 to its initial position.

Using rotating rubber track 148 in combination with reciprocating push rod 180 to deliver a dart from firing chamber 146 to flywheels 150*a*, 150*b* advantageously increases the speed with which the darts are delivered and overcomes the pressure applied to the dart in firing chamber 146 from those darts located above it in hopper 114. In this way, launcher 100 can shoots darts as fast as they can drop into firing chamber 146 from hopper 114.

When energized, upper flywheel 150*a* rotates clockwise and lower flywheel 150*b* rotates counterclockwise. In exemplary embodiments, both flywheels 150*a*, 150*b* may be energized when the user switches on/off switch 132 of launcher 100 into the "on" position. In embodiments, both flywheels 150*a*, 150*b* may be energized when the user pulls the trigger 128 of launcher 100. In embodiments, both flywheels 150*a*, 150*b* rotate at the same rotational velocity.

The physical construction of the darts can affect the ease with which the darts drop down from hopper 114 into single firing chamber 146. Specifically, the foam surfaces of the darts, in addition to the soft rubber or plastic tips of the darts, can cause friction among the darts that are housed in hopper 114. As a result, the darts may tend to jam together inside hopper 114, and thus they may not fall freely into single firing chamber 146. This tendency may be exacerbated when, as shown in FIG. 7A, first projectile guide member 140 and second projectile guide member 144 slope downwardly together to guide the darts toward firing chamber 146.

It can be frustrating to a user of a toy foam dart launcher to line up a perfect shot only to "fire a blank" due to a jam occurring in hopper 114.

Figure 11:
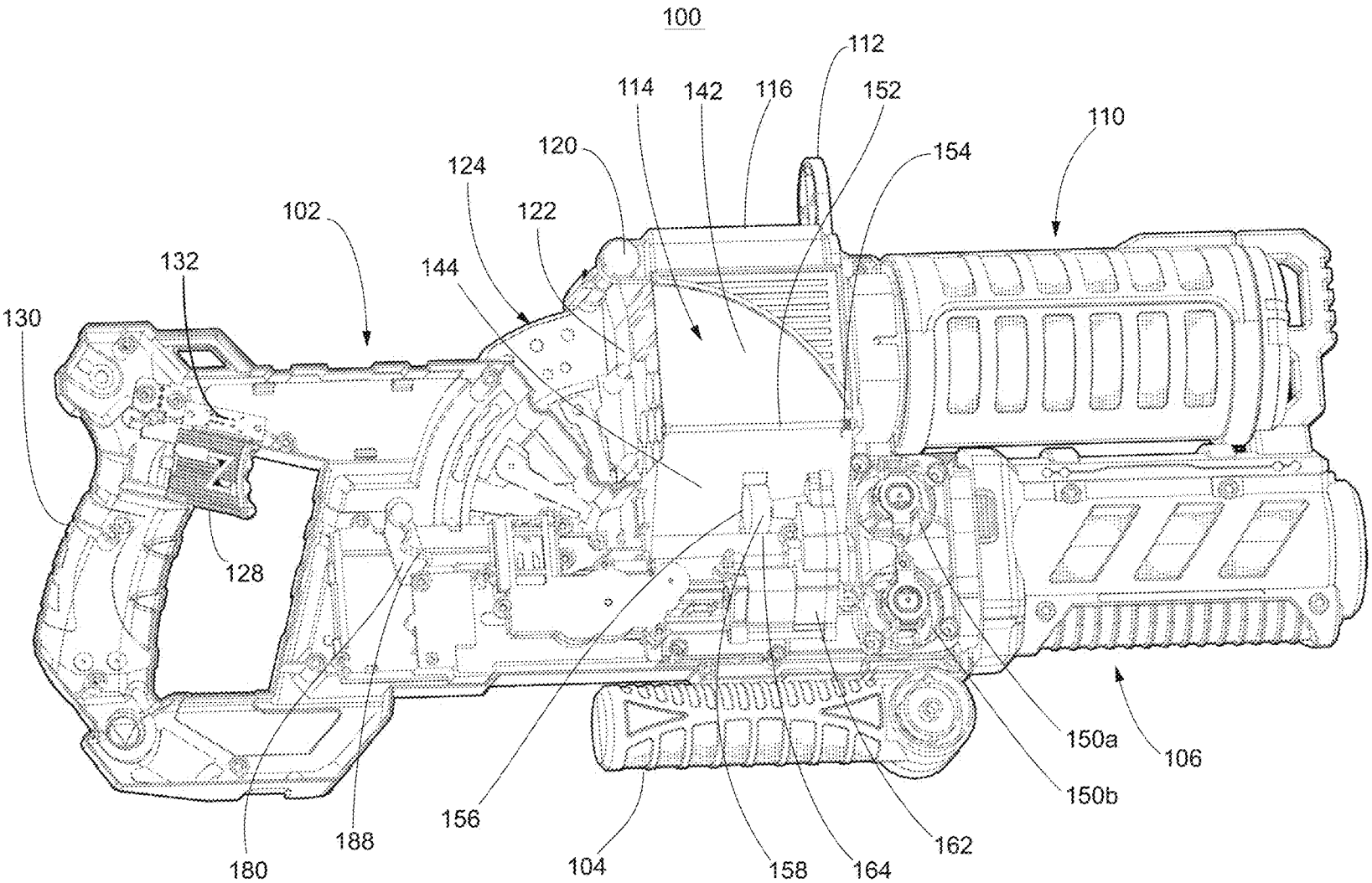
FIG. 11 illustratively depicts various elements of the toy projectile launcher in accordance with exemplary embodiments of the present invention.

One solution to the aforementioned problem is to agitate a portion of hopper 114. In exemplary embodiments, one portion of hopper 114 is agitated (e.g., moved up and down) to thereby loosen the darts in the hopper 114 so that they can fall freely into the single firing chamber 146. As shown in FIG. 11, in exemplary embodiments, second projectile guide member 144 is movably coupled to side wall 142, e.g., by a hinge 152. A torsion spring 154 is provided at one end of hinge 152. Second projectile guide member 144 includes an opening 156.

As shown in FIGS. 7A, 10, and 11, a wheel 158 protrudes through opening 156 of second projectile guide member 144. As shown in FIGS. 7A and 10, in embodiments, a finger 160 extends from the rim of wheel 158. In exemplary embodiments, finger 160 may be integrally formed with wheel 158. As shown in FIG. 11, in embodiments, wheel 158 is mechanically coupled to, and thus made to turn by, an electric motor 162 which is energized when the user pulls the trigger 128 of launcher 100.

In operation, prior to the time when a user pulls trigger 128, second projectile guide member 144 is disposed in a position that is defined by the unbiased position of torsion spring 154. When a user pulls trigger 128, motor 162 causes wheel 158 to turn. As wheel 158 turns, finger 160 periodically comes into contact with a bottom edge 164 of opening 156 of second projectile guide member 144. In embodiments, finger 160 and bottom edge 164 may have complementary beveled edges that facilitate contact therebetween. When finger 160 contacts bottom edge 164, finger 160 presses down on second projectile guide member 144, thereby winding torsion spring 154 as second projectile guide member 144 rotates downwardly on hinge 152.

Once finger 160 is no longer in contact with bottom edge 164 of opening 156, torsion spring 154 unwinds back to its unbiased position. In so doing, torsion spring 154 provides a return force to second projectile guide member 144, which causes second projectile guide member 144 to "kick" (i.e., lift) up slightly on hinge 152. This "kicking" up of second projectile guide member 144 is enough to shake the darts in hopper 114 loose so that one of them will fall into single dart chamber 146 at the bottom of hopper 114. As described above, once a dart falls in dart chamber 146, rotating track 148, with the assistance of reciprocating push rod 180, delivers the dart to flywheels 150*a*, 150*b*.

In embodiments, second projectile guide member 144 may include a horizontal ridge, and a cam mechanism may be coupled to the horizontal ridge to agitate second projectile guide member 144 to shake the darts in hopper 114 loose. It will be understood by those of ordinary skill in the art that any of a number of other means can be used to agitate second projectile guide member 144 in accordance with the present invention. In embodiments, first projectile guide member 140, rather than second projectile guide member 144, may be agitated to loosen the darts in hopper 114.

As they are being shaken loose by the "kicking" action of second projectile guide member 144, the darts tend to jump up and down within hopper 114. If the darts do not come back down with their tips pointing forward (i.e., toward barrel 106), they will not launch properly from launcher 100 and, consequently, their trajectories will be distorted. Specifically, the darts will not shoot far, and they will not shoot accurately.

In embodiments of launcher 100, cover 116 includes a collapsible ceiling assembly 166 which is attached to the underside of cover 116 by any suitable means that is well known to those of ordinary skill in the art, and thus will not be described further herein. In an exemplary embodiment shown in FIGS. 9 and 10, collapsible ceiling assembly 166 includes a plurality of nested members 168, 170, 172, 174, 176. When collapsible ceiling assembly 166 is collapsed, each one of nested members 168, 170, 172, 174 may be contained within the nested member that is immediately above it. When collapsible ceiling assembly 166 is fully collapsed against the underside of cover 116, nested members 168, 170, 172, 174 are all contained within nested member 168. A descending ceiling plate 178 in the collapsible ceiling assembly 166 is attached to nested member 176 by any suitable means that are well known to those of ordinary skill in the art and thus will not be described further herein. In embodiments, the shape of descending ceiling plate 178 will generally conform to the shape of hopper 114. In exemplary embodiments, descending ceiling plate 178 will have a generally square or rectangular shape.

Collapsible ceiling assembly 166 ensures that if the darts in hopper 114 jump up and down as a result of the "kicking" action of second projectile guide member 144, they come back down with their tips oriented properly, i.e., pointing forward toward barrel 106. Specifically, collapsible ceiling assembly 166 ensures the proper orientation of the darts in hopper 114 by preventing the darts from jumping up a distance that is greater than their length when they are agitated by the "kicking" action of second projectile guide member 144.

In operation, after darts have been loaded into hopper 114 and cover 116 and rear wall assembly have been locked into place in the manner described above, gravity causes collapsible ceiling assembly 166 to expand as nested members 170, 172, 174, 176 drop within the interior of hopper 114. As a result, descending ceiling plate 178 comes to rest on top of the pile of darts housed in hopper 114. The amount of weight applied to the pile of darts by descending ceiling plate 178 is heavy enough to prevent the darts from jumping up and down within hopper 114 while they are being agitated by the "kicking" action of second projectile guide member 144, but at the same time is light enough not to interfere with the "kicking" action of second projectile guide member 144 described above.

As a user fires darts from launcher 100, the level of darts inside hopper 114 drops. Nested members 170, 172, 174, 176 will drop further into the interior of hopper 114, in accordance with the drop in the level of darts inside hopper 114, so that descending ceiling plate 178 remains atop the pile of darts at all times when cover 116 is closed.

In the embodiments described above, there is a concern that when launcher 100 is loaded with darts 200 in hopper 114 and is turned away from an upright position, such as downwards, sideways or upside down, nested members 168, 170, 172, 174, 176 of ceiling 116 will collapse upward and the darts 200 that have already been organized in hopper 114 with the tips of the darts pointing toward the front of launcher 100 will shift and become jumbled.

Figure 12A:
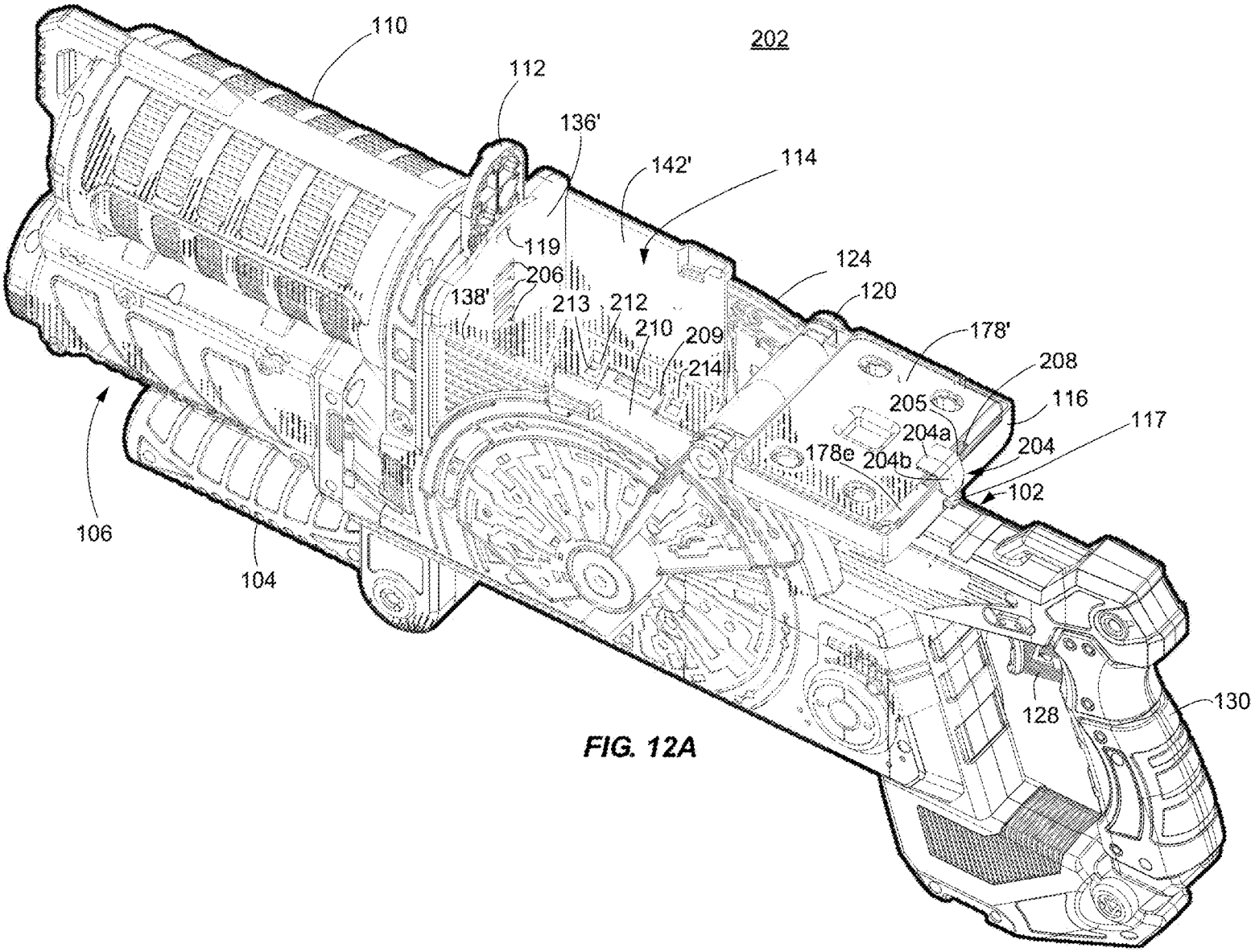
FIG. 12A depicts a toy projectile launcher, in accordance with additional exemplary embodiments of the present invention, that includes a catch for preventing the ceiling plate from collapsing (moving upward) within the hopper once the hopper cover is closed.
Figure 12B:
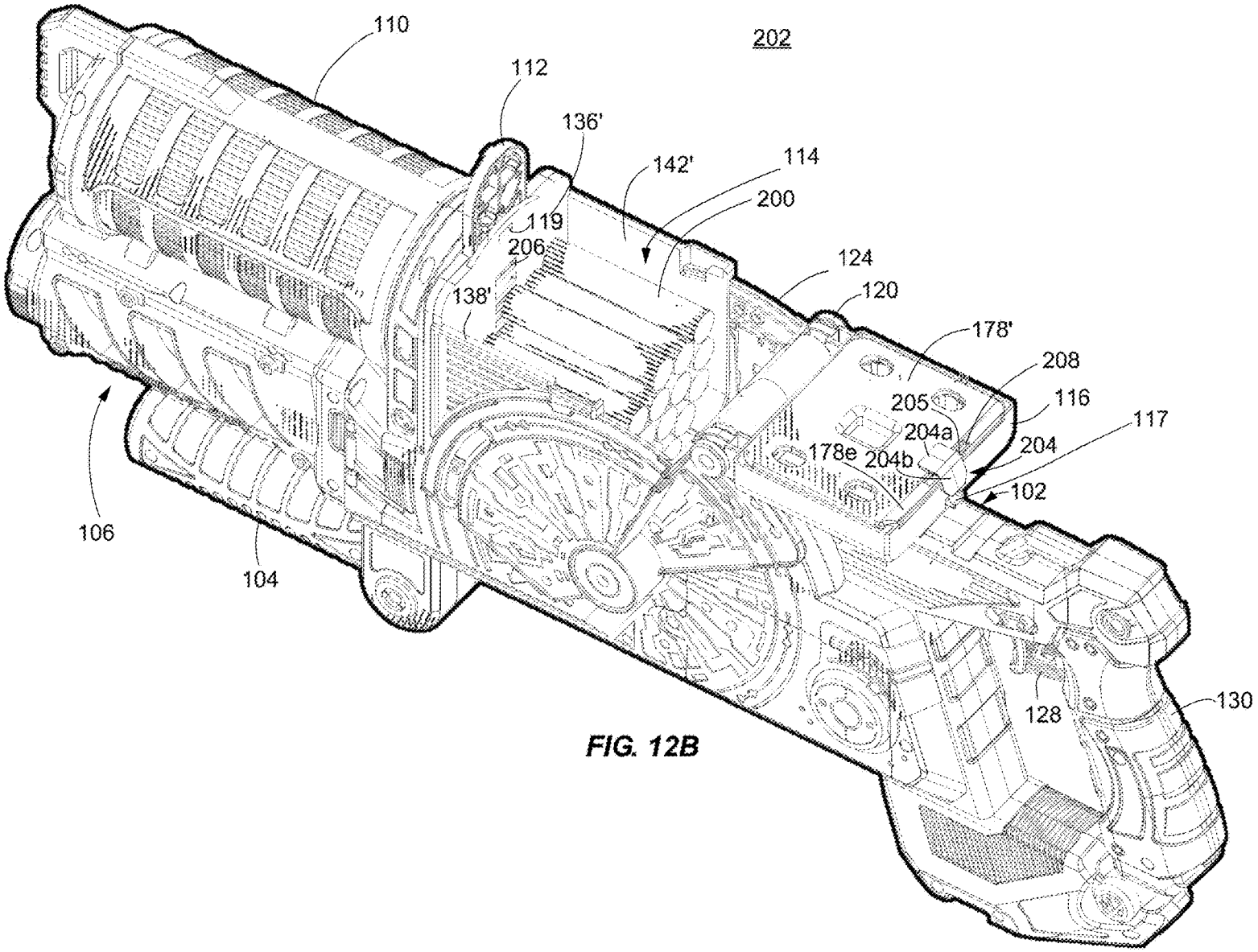
FIG. 12B depicts the toy projectile launcher of FIG. 12A after the hopper is loaded with darts and the hopper cover is open.
Figure 12C:
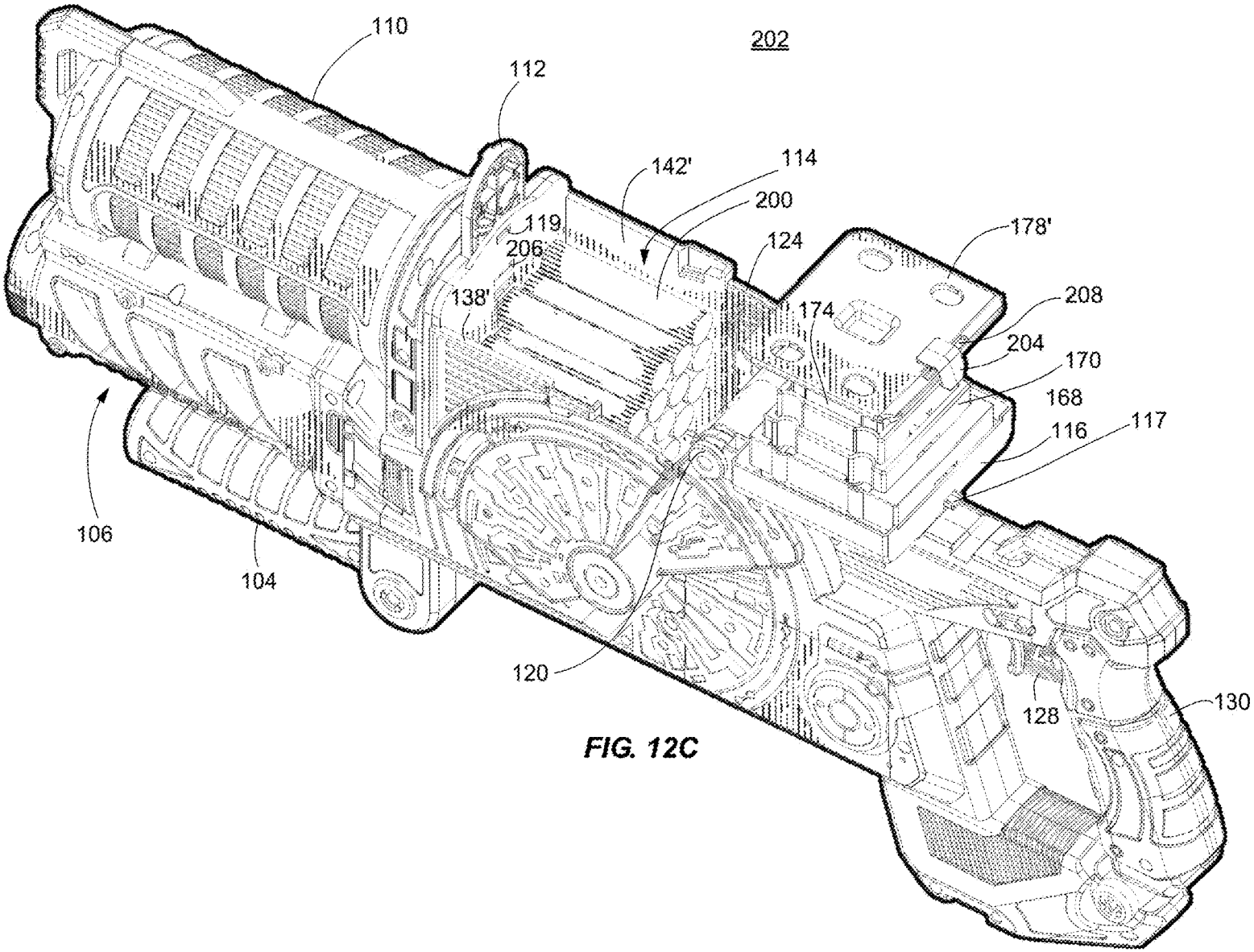
FIG. 12C depicts the toy projectile launcher of FIG. 12B in accordance with the additional exemplary embodiments of the present invention showing the nested members of the cover partially extended, with four nested members visible.

To address this concern, in additional exemplary embodiments, hopper 114 and cover 116 may be modified as shown with respect to launcher 202 in FIGS. 12A through 17B. Referring to FIGS. 12A, 12B, and 12C, launcher 202 is generally similar to launcher 100 with similar elements as indicated, but further includes a catch 204 coupled to the front of ceiling plate 178' that prevents upward movement of the collapsible ceiling assembly 166 but allows for downward expansion of the collapsible ceiling assembly 166. Catch 204, which may be a ratchet, operates in conjunction with a plurality of openings 206 that are spaced apart from one another and substantially vertically aligned, such as in a column, from an upper position to a lower position on front wall 136' of hopper 114. In embodiments, a column of openings 206 may, for example, be centered on front wall 136' below slot 119 for latch 117 on cover 116. In embodiments, catch 204 is coupled to descending ceiling plate 178' with a torsion spring 208 that is, for example, mounted over a rod that extends laterally across an interior surface 207*b* of descending ceiling plate 178'. In embodiments, descending ceiling plate 178' may include a curved extension 178*e* within which torsion spring 208 is retained.

Figure 13:
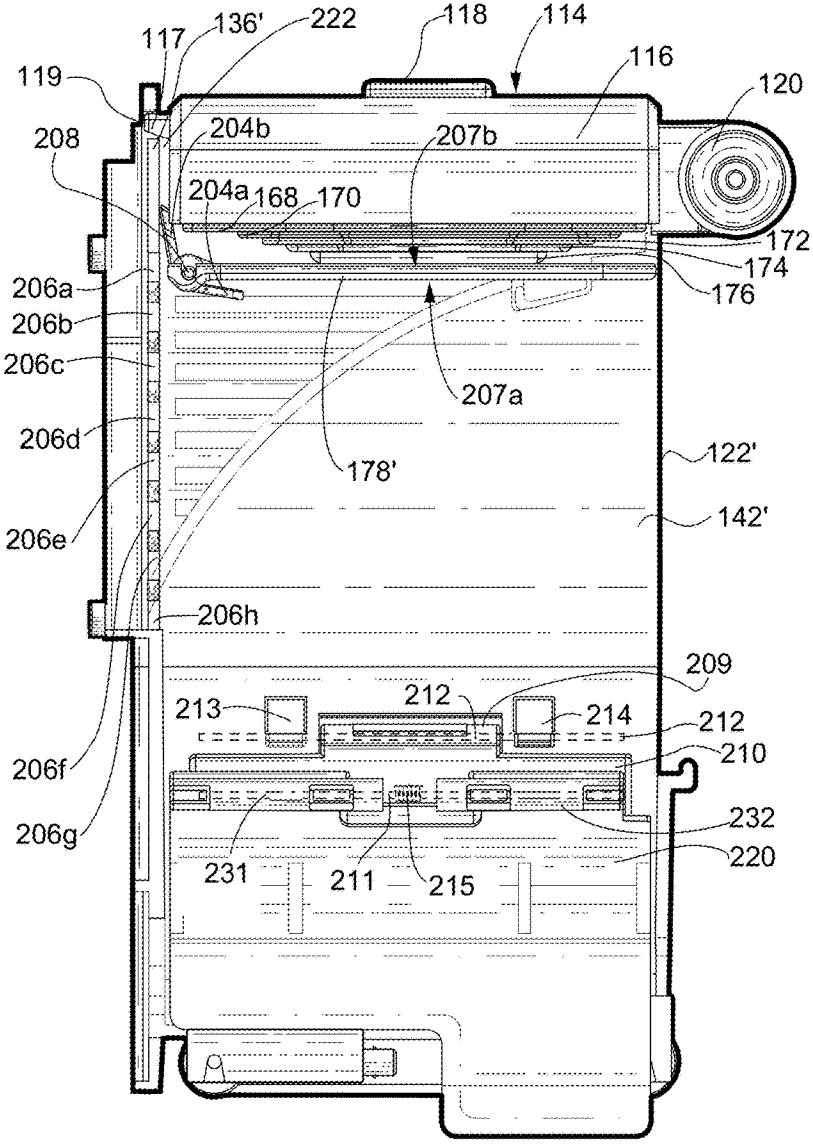
FIG. 13 depicts a plan view of the right side of closed hopper with a cutaway of the right hopper wall and the nested members substantially collapsed into a closed hopper in accordance with the additional exemplary embodiments of the present invention.

In embodiments, catch 204 includes a back end 204*a* and a front end 204*b* with a bend 205 therebetween that forms an obtuse angle between back end 204*a* and front end 204*b*. When cover 116 is open, back end 204*a* of catch 204 is coupled so as to be biased by spring 208 substantially against an exterior surface 207*a* of descending ceiling plate 178' and front end 204*b* of catch 204 is biased by spring 208 to be angled upward and forward toward the front of cover 116. In embodiments, when ceiling 116 is collapsed with nested members 168, 170, 172, 174, 176 nested inside one another, front end 204*b* projects upward in front of cover 116. As shown in FIG. 13, a space 222 may be provided between the front of cover 116 and front wall 136' of hopper 114 to accommodate second end 204*b* of catch 204.

There may be, for example, eight openings 206*a*, 206*b*, 206*c*, 206*d*, 206*e*, 206*f*, 206*g*, and 206*h* (from the top to the bottom of the hopper) in which catch 204 may engage, or there may be more or fewer then eight openings. In embodiments, openings 206 are spaced apart by a similar distance (e.g., 2 mm) or, in embodiments, openings 206 may be unevenly spaced.

Figure 14:
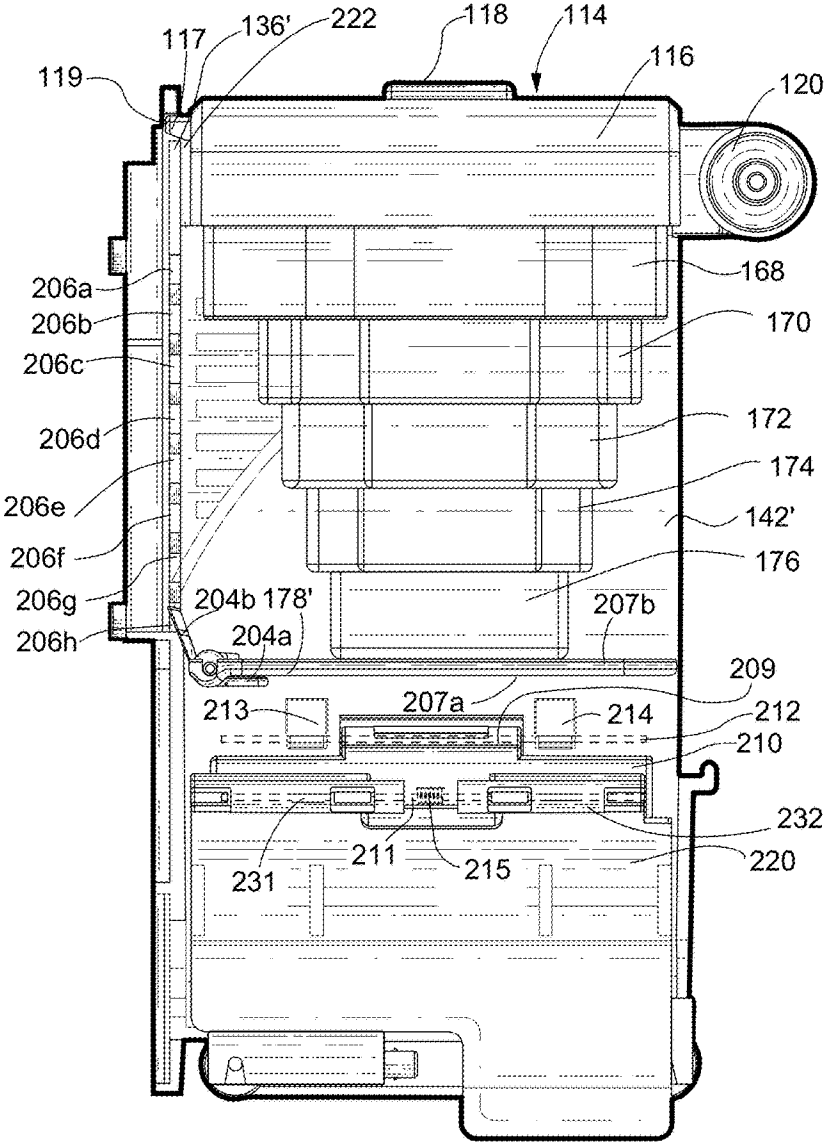
FIG. 14 depicts a plan view of the right side of closed hopper with a cutaway of the right hopper wall and the nested members substantially extended into a closed hopper in accordance with the additional exemplary embodiments of the present invention.

FIGS. 13 and 14 illustrate two of the various different positions of nested members 168, 170, 172, 174, 176 within hopper and catch 204, when cover 116 is closed on hopper 114. FIG. 13 illustrates one possible position of the nested members and catch 204 when hopper 114 is completely filled with darts (not shown) and FIG. 14 illustrates a second possible position of the nested members and catch 204 when there are relatively few darts (not shown) or no darts left in hopper 114.

Referring to FIG. 13, when hopper 114 is full, descending ceiling plate 178' is collapsed into cover 116, and catch 204 is located above top opening 206*a* on front wall 136' of hopper 114 as catch 204 may not be needed when hopper 114 is full to contain darts 200 in a desired position within hopper 114. However, as darts are launched from launcher 202, catch 204, descending ceiling plate 178' descends so that catch 204 engages the uppermost, first opening 206*a*. Then, when ceiling plate 178' further descends upon launching of additional darts, catch 204 disengages from first opening 206*a* and engages the next lower opening 206*b*. Next, ceiling plate 178' descends further when more darts are launched, and catch 204 disengages from opening 206*b* and engages opening 206*c*. This process continues for each consecutive lower opening 206*d*, 206*e*, 206*f*, 206*g* of openings 206 until the darts are greatly depleted from hopper 114, so that, as illustrated in FIG. 14 catch 204 is lowered to engage the lowest opening 206*h* on front wall 136'. As it descends between openings 206, front end 204*b* of catch 204 rotates backward about spring 208. Catch 204 is restored to a biased position about spring 208 when it enters a respective one of openings 206. Catch 204 is disengaged from whichever one of openings 206 in which it is engaged when movable rear wall assembly 124 is opened backward.

Figure 15A:
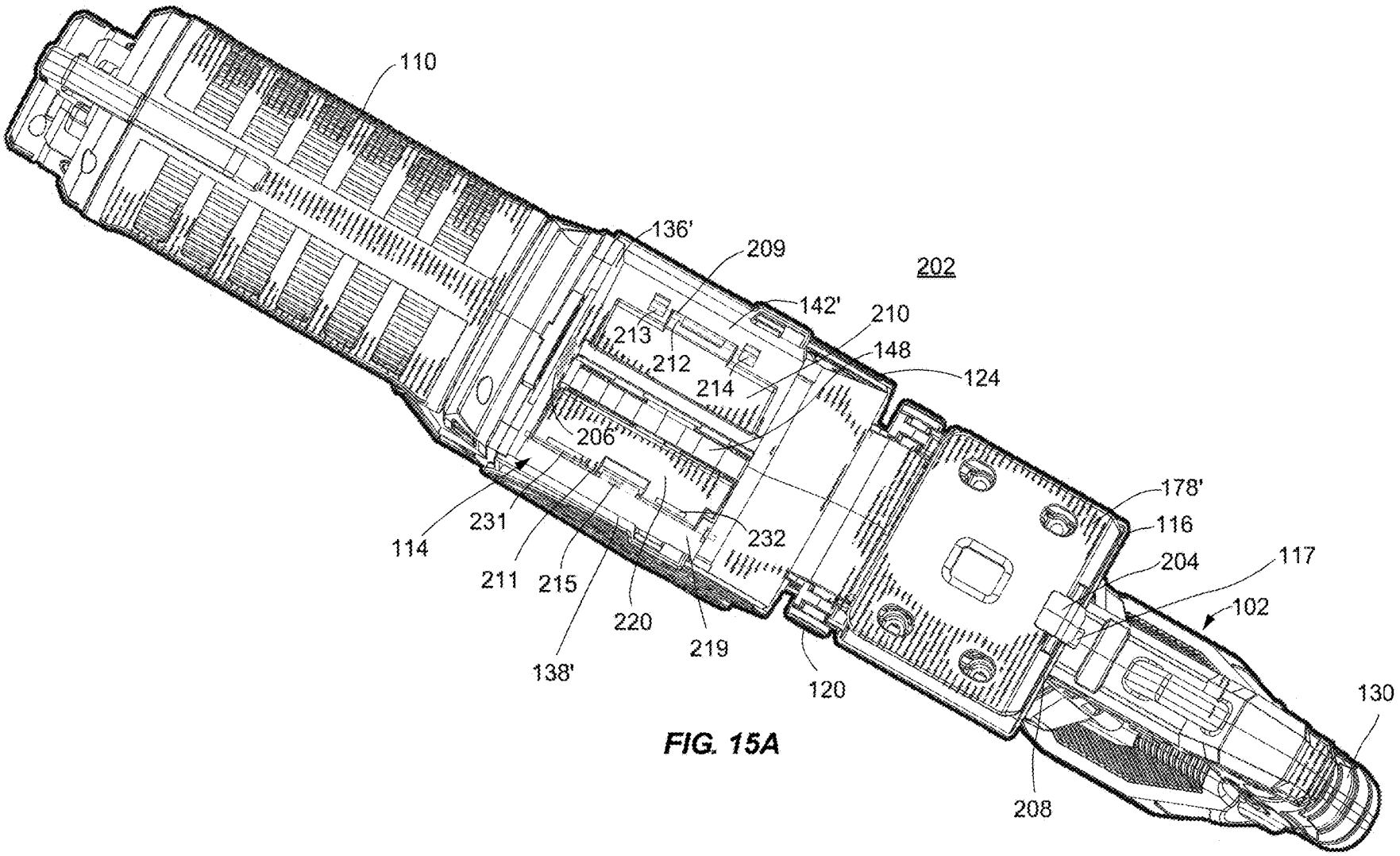
FIG. 15A shows a top view of the toy projectile launcher with the hopper cover open and the hopper, when empty of darts, in accordance with the additional exemplary embodiments of the present invention.
Figure 15B:
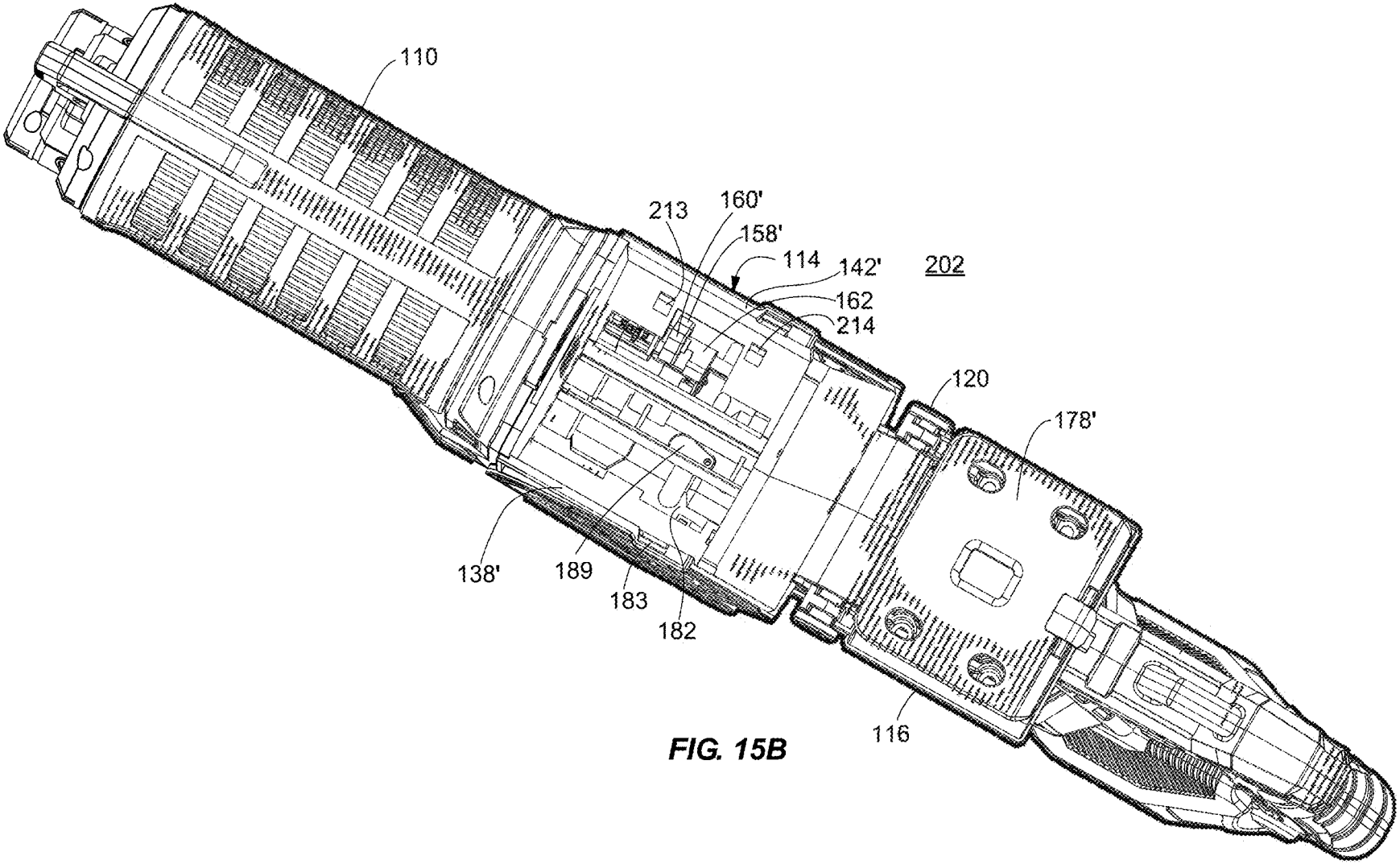
FIG. 15B shows a top view of the toy projectile launcher in accordance with the additional exemplary embodiments of the present invention with the hopper cover open and the first and second agitating members and the rotating rubber track removed.
Figure 15D:
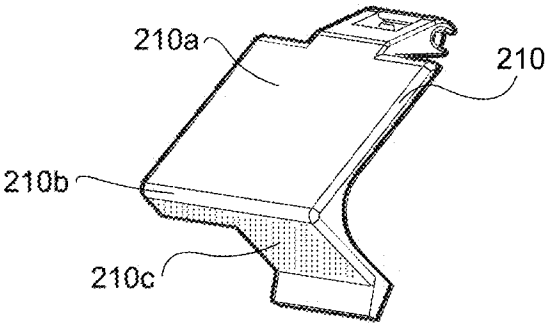
FIG. 15D shows a perspective view of the left side agitating member removed from FIG. 15B.
Figure 15C:
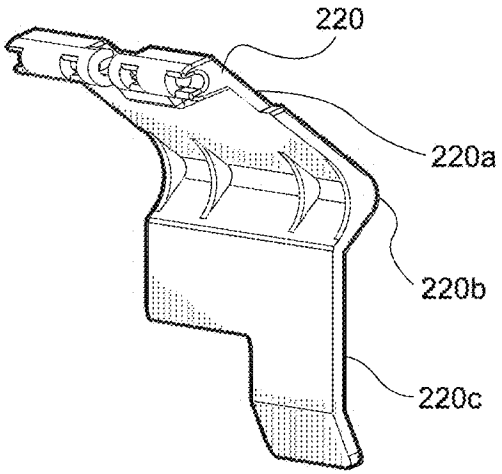
FIG. 15C shows a perspective view of the right side agitating member removed from FIG. 15B.

In addition to the addition of a catch 204, as shown in FIG. 15A, launcher 202 may also include at least two agitating members 210, 220, rather than just one agitating member (projectile guide member), to better agitate the darts to move downward toward firing chamber 146 for launch. A first agitating member 220 is associated with a left side wall 142' on the left side of hopper 114 and a second agitating member 210 is associated with a right side wall 138' on the right side of hopper 114. Each agitating member 210, 220 is provided with an agitating mechanism that agitates the respective agitating member. In embodiments, agitating members 210, 220 may each include an agitating panel, as shown in FIGS. 15C and 15D, that covers agitating mechanisms (described below) so that the agitating mechanisms for agitating members 210, 220 are not visible to a user and cannot come into contact with a user when hopper 114 is open. FIG. 15B shows launcher 202 with the agitating members 210, 220 removed to expose exemplary agitating mechanisms.

As shown in the embodiment in FIGS. 12A and 15, right and left side walls 138', 142' of hopper 114 in launcher 202 are configured somewhat differently from the configuration of launcher 100 that is illustrated in FIG. 7A.

Right side wall 138' of launcher 202 includes an upper portion that extends vertically and a lower portion that slopes inwardly toward rotating rubber track 148 and firing chamber 146. An opening in the sloped, lower portion of right side wall 138' exposes an agitating mechanism for the right side of hopper (and described below with reference to FIG. 16B) to agitate agitating member 220. In embodiments, agitating member 220 is connected with rod 211 to hinges 231, 232 at the top of agitating member 220, so as to cover at least a portion of the sloped, lower portion of wall 138' where the right side agitating mechanism is exposed. Rod 211 may also pass through a passage in wall 138' to strengthen the hinged connection of agitating member 220 to wall 138'. Agitating member 220 thus serves as a first projectile guide member.

An exemplary embodiment of agitating member 220 is shown in FIG. 15C and, may include a top section 220*a* that is visible in hopper 114, an inner middle section 220*b* that slopes backward and downward into housing 102, and a lower section 220*c*. Agitating member 220 may be biased downward by a torsion spring 215 inserted between wall 138' and agitating member 220 around rod 211. When a right side agitating mechanism, an embodiment of which is described below, makes contact with agitating member 220, the middle section 220B of agitating member 220 is caused by the agitating mechanism, to rise intermittently push upward and then return downward by the biased force of torsion spring 215.

Left side wall 142' includes an upper portion that extends vertically and a lower portion that slopes inwardly toward rotating rubber track 148 and firing chamber 146. An opening in the sloped, lower portion of wall 142' exposes a second agitating mechanism for the left side of hopper (and described below with reference to FIG. 17B) to agitate agitating member 210. In embodiments, agitating member 210 is connected with a rod 212 to hinge 209, at the top of plate 210, so that it covers at least a portion of the sloped, lower portion of wall 142' where the left side agitating mechanism is exposed. Agitating member 210 may be biased downward by a torsion spring (not shown) around rod 212. Rod 212 may also pass through passage 213, 214 on opposite sides of hinge 209 in wall 142' for strengthening the hinged connection of agitating member 210 to wall 142'.

An exemplary embodiment of agitating member 210 is shown in FIG. 15D.

Agitating member 210 includes an upper portion 210*a*, a curved middle portion 210*b* that is generally biased downward within hopper 114, and a lower portion 210*c*. Agitating member 210 may be agitated by a left side agitating mechanism, an embodiment of which is described below. When agitating member 210 makes contact with the underside of agitating member 210 such as at a lower portion 210*c* of agitating member 210, agitating member 210 is intermittently pushed upward and agitating member 210 agitates darts in hopper 114. Agitating member 210 thus serves as a second projectile guide member.

Agitating members 210, 220 may be agitated by similar or different agitating mechanisms. In embodiments, the particular agitating mechanisms that are used may be selected based in part on agitating forces and/or space constraints within housing 102.

Figure 16B:
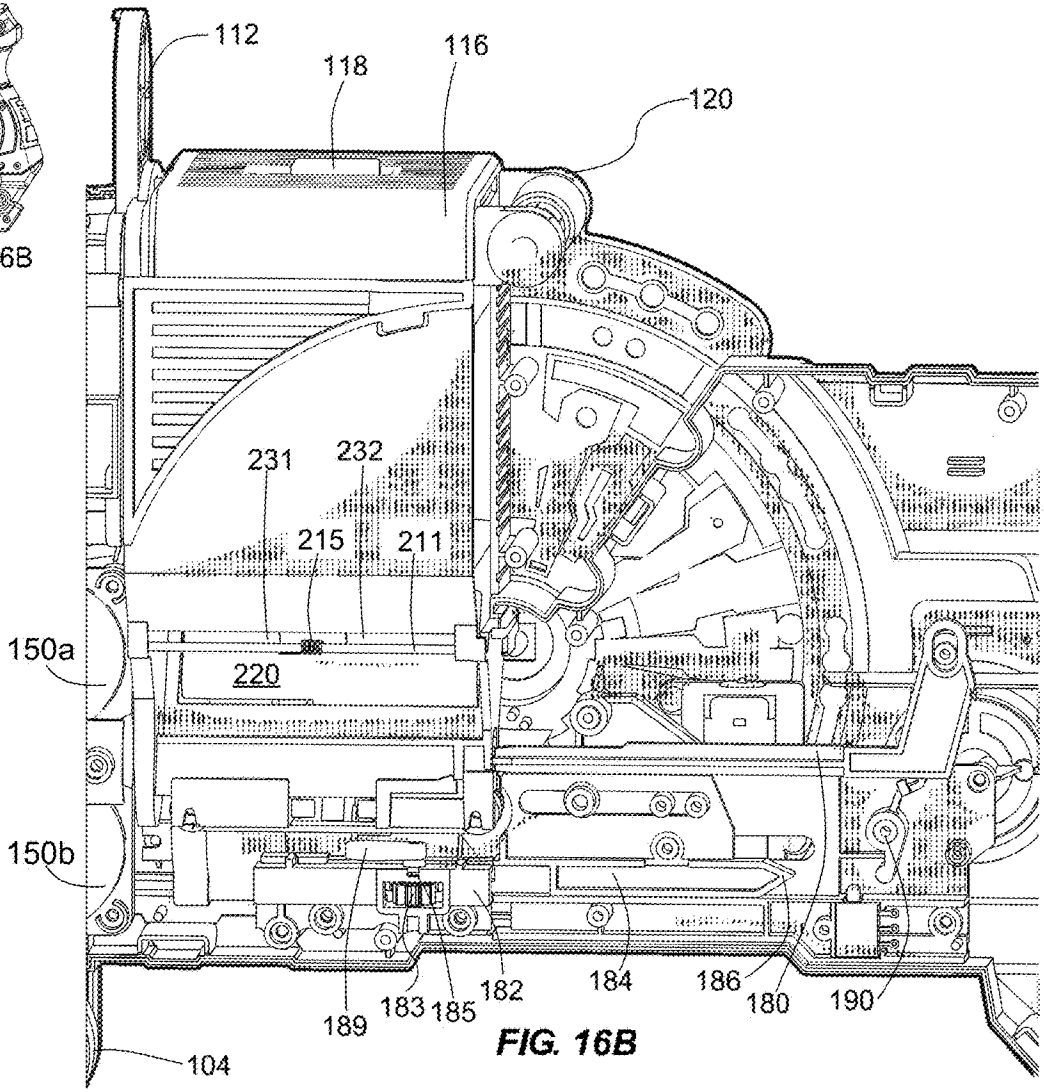
FIG. 16B shows an aligned partial right side view of the toy projectile launcher with a bottom section of the launcher cutaway in accordance with the additional exemplary embodiments of the present invention.
Figure 16A:
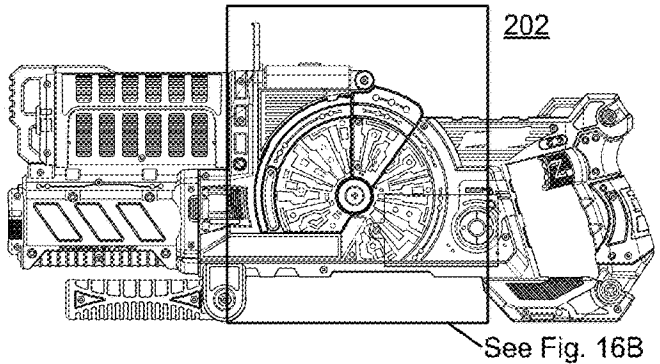
FIG. 16A shows a right side view of the toy projectile launcher in accordance with the additional exemplary embodiments of the present invention and indicates a portion of the toy projectile launcher shown in more detail in FIG. 16B.
Figure 17B:
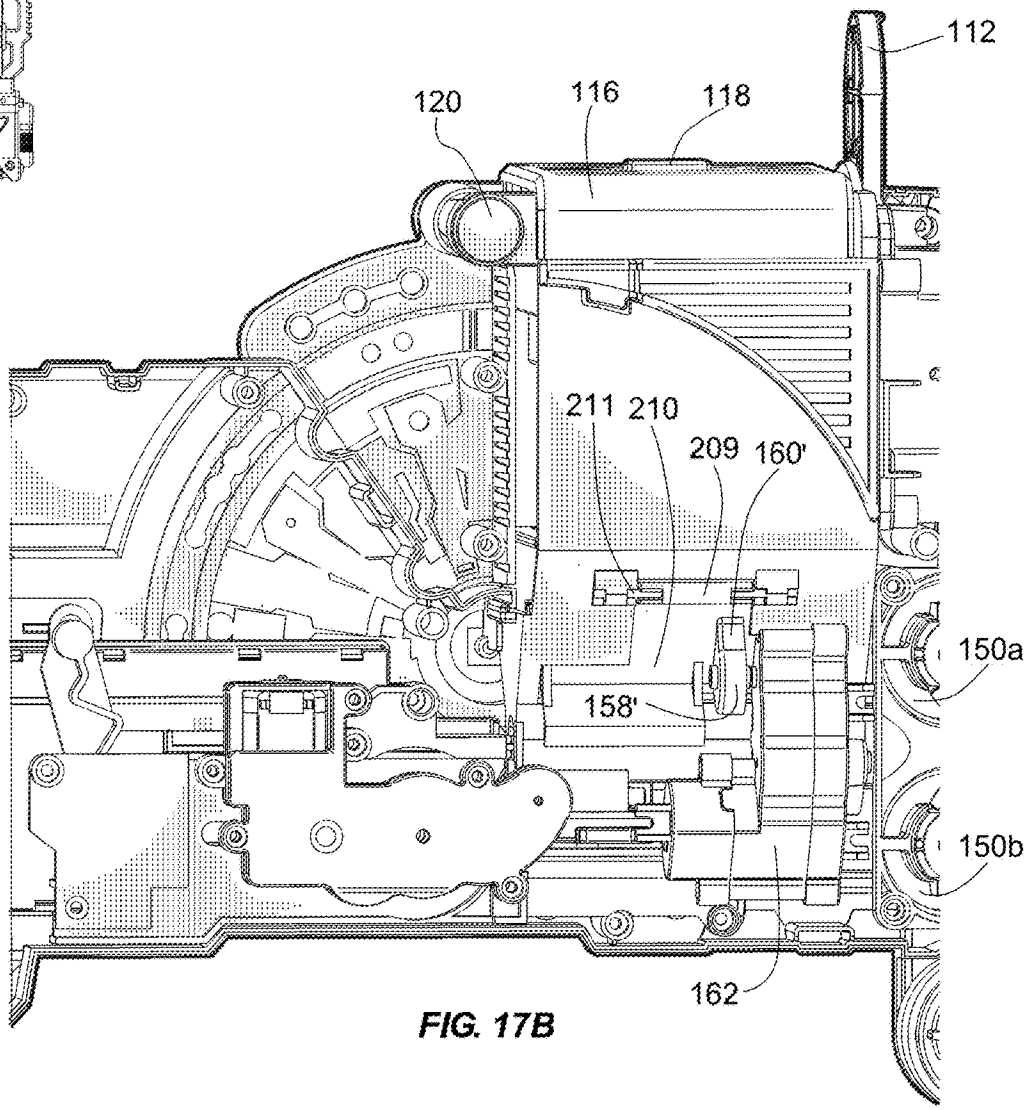
FIG. 17B shows an aligned partial left side view of the toy projectile launcher with a bottom section of the launcher cutaway in accordance with the additional exemplary embodiments of the present invention.
Figure 17A:
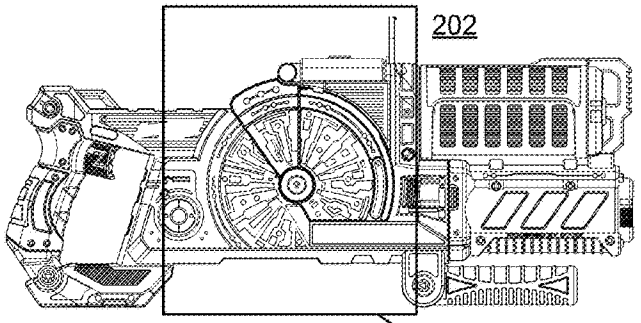
FIG. 17A shows a left side view of the toy projectile launcher in accordance with the additional exemplary embodiments of the present invention and indicates a portion of the toy projectile launcher shown in more detail in FIG. 17B.

In an exemplary embodiment shown in FIGS. 16B and 17B, different agitating mechanisms are used. FIG. 16B shows an example of a first agitating mechanism on the right side of hopper 114 that may be used to agitate agitating member 220 and FIG. 17B shows an example of a second agitating mechanism on the left side of hopper 114 that may be used to agitate agitating panel 210.

An exemplary embodiment of a first agitating mechanism is shown in FIGS. 15B and 16B. In embodiments, the first agitating mechanism may include a wheel (e.g., a gear) 183 coupled via a shaft 185 to an arm 189 that is rotatable about shaft 185. Arm 189 causes agitation by coming into intermittent contact with the underside of agitating member 220. In embodiments, the rotation may proceed in a single direction or, in embodiments, wheel 183 may be driven to oscillate so that it rotates first in one of a clockwise direction and a counterclockwise direction and then in the reverse direction. Wheel 183 is driven by a motor which, in embodiments, may be a motor dedicated to driving wheel 183 or may be coupled to a motor used to power another motorized component in launcher 202, such as a motor for driving rotating rubber track 148.

In operation, before a user pulls trigger 128, agitating member 220 is disposed in a first, lowered position. Upon a user pressing trigger 128, wheel 183 is driven to be rotated. When wheel 183 rotates, arm 189 periodically contacts the underside of agitating member 220, thereby causing the agitation of agitating member 220 to agitate the right side of hopper 114.

In particular, agitating member 220 is "kicked" up by each contact with arm 189 causing agitating member 220 to rotate upward about hinges 231, 232. When arm 189 moves out of contact with agitating member 220, agitating member 220 returns downward. This "kicking" up of agitating member 220 works in conjunction with agitating member 210 to shake the darts in hopper 114 loose so that one of them will fall into firing chamber 146 at the bottom of hopper 114. In embodiments, the same type of agitating mechanism may be used to agitate agitating member 210 in lieu of the second agitating mechanism, described below.

An exemplary embodiment of a second agitating mechanism, that may be used for example to agitate agitating member 210, is shown in FIGS. 15B and 17B. In embodiments, the second agitating mechanism may include a rotating wheel 158', similar to wheel 158 in the embodiments shown with respect to FIG. 7A, having a finger 160' that periodically contacts the underside of agitating member 210 as wheel 158', thereby causing the agitation of agitating member 210.

In operation, before a user pulls trigger 128, agitating member 210 is disposed in a first, lowered position. When a user pulls trigger 128, motor 162 causes wheel 158 to turn. As wheel 158' turns, finger 160' periodically comes into contact with a location near the bottom of agitating member 210. When finger 160' contacts agitating member 210, "kicks" up the bottom of agitating member 210 causing agitating member 210 to rotate upward about hinge 211. When finger 160' moves out of contact with agitating member 210, agitating member 210 returns downward. This "kicking" up of agitating member 210 works in conjunction with agitating member 220 to shake the darts in hopper 114 loose so that one of them will fall into firing chamber 146 at the bottom of hopper 114. In embodiments, the same type of agitating mechanism may be used to agitate agitating member 220 in lieu of the first agitating mechanism having a wheel 183 and related components.

In exemplary embodiments, agitating members 210, 220 may be sequentially activated with agitation of the hopper alternating between agitation by agitating member 210 and agitation by agitating member 220. Thus, a first one of the agitating members 210, 220 agitates, then a second one of the agitating members 210, 220 agitates, then the first agitating member agitates, etc. Sequential activation may be achieved by various known methods such as, for example, by controlling motor speeds for and sizing of the agitating mechanisms so that both agitating members 210, 220 do not agitate at the same time.

Also, in exemplary embodiments, agitating members 210, 220 may be substantially simultaneously agitated. In other embodiments, agitating members 210, 220 may be configured to sometimes agitate agitating members 210, 220 simultaneously and to sometimes agitate agitating members 210, 220 sequentially.

In embodiments, the first and second agitating mechanisms may be independently controlled so that one agitating mechanism may be disabled. In other embodiments, a single agitating mechanism may be used to agitate two agitating members, whether simultaneously or sequentially.

In embodiments, there may also be more than two agitating members included in a hopper 114.

It should be understood that while they are illustrated in the context of launcher 202, the use of dual agitating members and mechanisms is a feature that may be implemented with or independently of the presence of a catch 204 for preventing a collapse of the collapsible ceiling assembly 166. Likewise, the use of a catch 204 may be implemented where a hopper has only a single agitating member and agitating mechanism.

As described above with respect to the exemplary embodiments described with respect to FIGS. 1 to 11, once a dart falls in dart chamber 146, rotating rubber track 148, with the assistance of reciprocating push rod 180, delivers the dart to flywheels 150*a*, 150*b* to launch the dart.

In alternative embodiments, collapsible ceiling assembly 166 may include a lightweight extension spring instead of nested members 168, 170, 172, 174, 176. The extension spring may be coupled at one end to the underside of cover 116 and at its other end to descending ceiling plate 178 or 178'. In such alternative embodiments, gravity again causes collapsible ceiling assembly 166 to expand as the spring extends into the interior of hopper 114 so that descending ceiling plate 178 or 178' again comes to rest on top of the pile of darts housed in hopper 114.

As described herein, the embodiments in accordance with the present invention provide an elegant and economical solution to the problem of providing a toy projectile launcher, e.g., a toy foam dart launcher, that can launch a substantially large number of projectiles without reloading.

While this invention has been described in conjunction with the embodiments outlined above, it is evident that many alternatives, modifications and variations will be apparent to those skilled in the art. Accordingly, the embodiments of the invention, as set forth above, are intended to be illustrative, not limiting. Various changes may be made without departing from the spirit and scope of the invention.

What is claimed is:

1. A toy projectile launcher, comprising:

a housing defining an elongated interior recess; and a hopper coupled to the interior recess of the housing, the hopper configured to house one or more projectiles and to provide the one or more projectiles from a bottom of the hopper to the interior recess of the housing to be launched from the housing, wherein the hopper comprises:

a first wall located to a right side of the elongated interior recess and a second wall located to a left side of the elongated interior recess when the elongated interior recess is viewed along a length in a direction of projectile launch, wherein both the first wall and the second wall extend upwardly relative to the bottom of the hopper; and at least two agitating members, including:

a first agitating member rotatably coupled to the first wall;

a second agitating member rotatably coupled to the second wall;

a first agitating mechanism for agitating the first agitating member, the first agitating mechanism comprising a first wheel having a finger extending therefrom and configured to agitate the first agitating member by intermittent contact between the finger and the first agitating member; and a second agitating mechanism for agitating the second agitating member;

wherein the first and second agitating members are configured to cause the one or more projectiles to align within the hopper.

2. The toy projectile launcher of claim 1, wherein the second agitating mechanism comprises a second wheel having a finger extending therefrom and configured to agitate the second agitating member by intermittent contact between the finger and the second agitating member.

3. The toy projectile launcher of claim 1, wherein the first and second agitating members are configured to be agitated substantially simultaneously.

4. The toy projectile launcher of claim 1, wherein the first and second agitating members are configured to be agitated one at a time.

5. The toy projectile launcher of claim 1, wherein the first and second agitating members are configured to be sequentially activated with agitation in the hopper alternating between agitation by the first agitating member and agitation by the second agitating member.

6. The toy projectile launcher of claim 1, wherein the second agitating mechanism comprises a second wheel coupled to an arm that is configured to agitate the second agitating member by intermittent contact between the arm and the second agitating member.

7. The toy projectile launcher of claim 6, wherein the second wheel is configured to alternate between rotation in a clockwise direction and in a counterclockwise direction.

8. The toy projectile launcher of claim 1, wherein the first agitating member slopes downwardly to the housing to guide the one or more projectiles into the interior recess of the housing.

9. The toy projectile launcher of claim 1, wherein the second agitating member slopes downwardly to the housing to guide the one or more projectiles into the interior recess of the housing.

10. The toy projectile launcher of claim 1, wherein:

the interior recess of the housing includes a firing chamber; and the first and second agitating members are configured to guide the one or more projectiles into the firing chamber.

11. The toy projectile launcher of claim 1, wherein the firing chamber comprises a rotating track to advance the one or more projectiles from the firing chamber.

12. The toy projectile launcher of claim 1, wherein the one or more projectiles are to be provided to the interior recess of the housing one at a time.

13. The toy projectile launcher of claim 1, wherein the first agitating member is coupled to the first wall by a first hinge and the second agitating member is coupled to the second wall by a second hinge.

14. The toy projectile launcher of claim 1, wherein the one or more projectiles comprise toy foam darts.

* * * * *